US010465724B2

(12) United States Patent
Lee et al.

(10) Patent No.: US 10,465,724 B2
(45) Date of Patent: Nov. 5, 2019

(54) PISTONLESS CYLINDER USED FOR OFFSHORE PILE GRIPPER

(71) Applicants: James J. Lee, Richmond, TX (US); William W. Lee, Arcadia, CA (US)

(72) Inventors: James J. Lee, Richmond, TX (US); William W. Lee, Arcadia, CA (US)

( * ) Notice: Subject to any disclaimer, the term of this patent is extended or adjusted under 35 U.S.C. 154(b) by 0 days.

(21) Appl. No.: 16/207,180

(22) Filed: Dec. 2, 2018

(65) Prior Publication Data

US 2019/0186506 A1 Jun. 20, 2019

Related U.S. Application Data

(63) Continuation-in-part of application No. 15/846,240, filed on Dec. 19, 2017, now Pat. No. 10,145,081.

(51) Int. Cl.

| | |
|---|---|
| ***F15B 15/10*** | (2006.01) |
| ***F15B 11/16*** | (2006.01) |
| *E02D 13/00* | (2006.01) |

(52) U.S. Cl.

CPC ..... *F15B 15/10* (2013.01); *F15B 11/16* (2013.01); *E02D 13/00* (2013.01); *F15B 2215/30* (2013.01)

(58) Field of Classification Search

CPC combination set(s) only.

See application file for complete search history.

(56) References Cited

U.S. PATENT DOCUMENTS

| | | | | | |
|---|---|---|---|---|---|
| 4,976,191 | A * | 12/1990 | Suzumori | B23Q 1/34 | 92/103 R |
| 5,299,790 | A * | 4/1994 | Whightsil, Sr. | E21B 19/006 | 267/292 |
| 5,366,048 | A * | 11/1994 | Watanabe | F16F 9/0472 | 188/267.1 |
| 5,429,035 | A * | 7/1995 | Kaneko | F15B 15/222 | 91/26 |
| 5,489,009 | A * | 2/1996 | Kawamata | F16F 9/103 | 188/267.1 |
| 6,427,577 | B1 * | 8/2002 | Lee | F15B 15/103 | 92/52 |

* cited by examiner

*Primary Examiner* — Kyle Armstrong

(74) *Attorney, Agent, or Firm* — Liu Law Group, pllc

(57) ABSTRACT

A simplified and improved pistonless cylinder based on an Aramid fiber reinforced elastomer tubular which is highly stiff in radial direction against radial expansion and elastic in axial extension, so as to form a completely sealed and extendable pressure chamber and to be able to perform as well as, or better than, most of the conventional hydraulic cylinders in terms of load bearing capacities, maximum stroke distances and service durability. This simplified cylinder employs no piston, piston rod, sealing seals or oil based hydraulic fluid, and utilizes non-metal materials to construct the majority of the parts for its extendable pressure chamber; therefore, this new cylinder can achieve significant weight and fabrication cost reduction. In addition, this new pistonless cylinder uses ordinary liquids, e.g., fresh water or seawater, as its hydraulic fluid, and can work directly as a hydraulic or pneumatic cylinder interchangeably without a need for much, if any, modification.

21 Claims, 16 Drawing Sheets

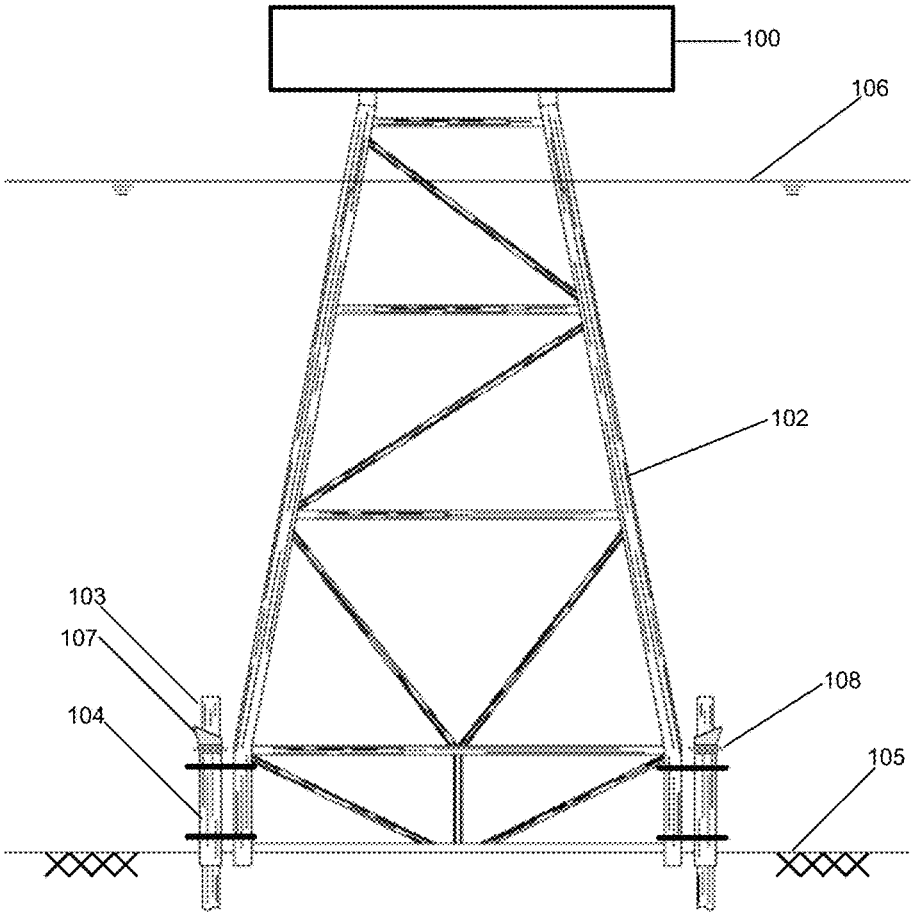
FIG. 1 （Prior Art)

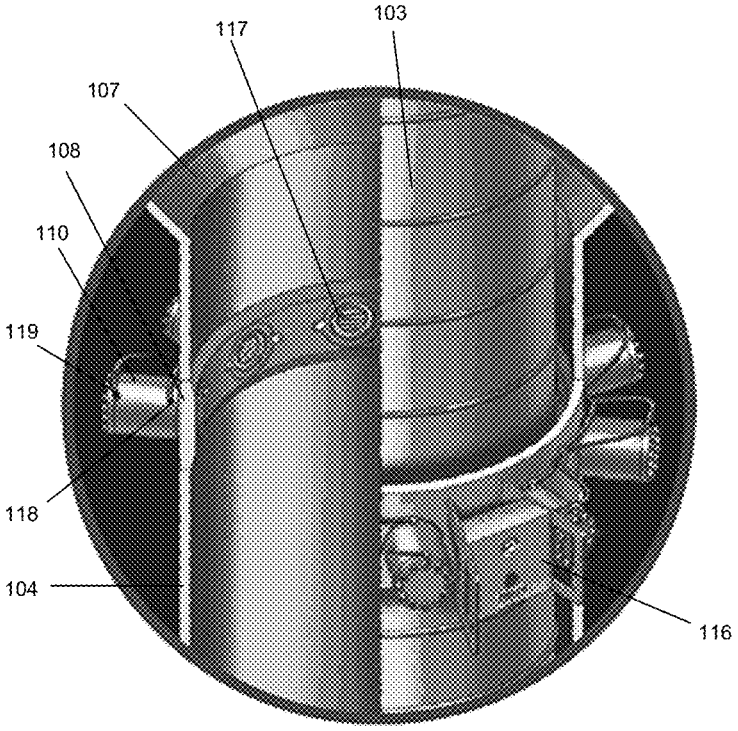
FIG. 2A （Prior Art)

PISTONLESS CYLINDER USED FOR OFFSHORE PILE GRIPPER

CROSS-REFERENCE TO RELATED APPLICATIONS

This Application is a continuation-in-part of application Ser. No. 15/846,240, filed on 19 Dec. 2017.

FIELD OF THE INVENTION

The disclosure relates generally to a new type of cylinder which employs neither piston nor sliding O-ring seal or ring, and one of the applications of such new cylinder is for substitution of conventional hydraulic cylinders used for offshore pile grippers.

BACKGROUND OF THE INVENTION

During the installation of offshore platforms or similar structures, a set of pile grippers is typically utilized to secure a platform to the ocean floor. FIG. 1 illustrates an offshore platform with a deck 100 above water surface 106 and the deck 100 is supported by extended jacket legs 102 grounded to the sea floor 105. There is a plurality of skirt pile sleeves 104, each for housing one driven pile 103 through the middle of the sleeve. A plurality of pile grippers 108, typically one gripper 108 per jacket corner leg 102, are installed at a corresponding sleeve 104 top and below a stabbing guide 107. When activated, the pile gripper 108 mechanically grips the driven pile 103 through a plurality of hydraulic cylinders and locks the offshore platform through the corresponding sleeve 104 to the ocean floor 105. Typically, the grippers 108 need to be activated/engaged and deactivated/released several times during a jacket leveling operation before grouting. After grouting, the piles 103 and sleeves 104 are permanently fixed to each other and then all the pile grippers 108 are released.

A conventional pile gripper of prior art comprises a plurality of hydraulic cylinders evenly spaced and circumferentially mounted in a steel can and then welded to a jacket leg or a skirt pile sleeve. These hydraulic cylinders are usually powered by a hydraulic pump operated at the surface of an offshore platform and are connected via a supply line to each gripper assembly near the ocean floor. These hydraulic grippers can also be operated by ROV or via diver intervention. As described above, a mechanical lock can be activated by applying hydraulic pressure via cylinders forcing the front head of each cylinder, which has a head plate with tooth rows, towards the driven pile for gripping action. Once contact is made between the pile outer surface and the cylinder head's teeth, the cylinder front head deforms the pile outer surface locally around the point of contact for tighter gripping effect. In short, a conventional pile gripper needs to have high gripping power, to be relatively small in cylinder size with high internal pressure and a relative short stroke, to be resistant to seawater corrosion and, above all, to have high overall system reliability. However, the required stroke distance for each cylinder is typically limited.

A Conventional Pile Gripper

FIG. 2A illustrates an ISO cut-off view of a conventional pile gripper 108 with a steel can, whose wall is thicker than the sleeve 104 wall below, and with a plurality of evenly spaced hydraulic cylinders 110 circumferentially mounted and fixed in the steel can and at the top of the sleeve 104 below a stabbing guider 107 and with a control assembly 116 attached. A driven pile 103, with rows of shear keys at pile top outer surface, is placed through the middle of the sleeve 104 with a gripping mechanism. There are tooth rows 117 at the surface of the front head plate 125 of each cylinder 110 and there are a pair of hydraulic fluid lines 118, 119, for each cylinder 110, 119 for pushing the cylinder head plate inward and 118 for retracting the cylinder head plate 125 backward.

FIG. 2B illustrates the top view of the evenly spaced hydraulic cylinders 110 circumferentially mounted at the gripper 108 steel can, without the control assembly 116, in an engaged configuration with cylinders 110 extended and the teeth 117 contacting the driven pile 103 outer surface for a gripping action.

FIG. 2C illustrates the cut-off section view from FIG. 2B with the evenly spaced hydraulic cylinders 110 in the gripper 108 and with teeth 117 from each extended hydraulic cylinder front head plate 125 surface.

A Conventional Hydraulic Cylinder Used for Pile Gripper

FIG. 3A illustrates a cross section view of a conventional hydraulic cylinder 210, fixed in a steel can (not shown) and used for a pile gripper (not shown), comprising a piston 222, a piston rod 223 placed within a barrel 228, and a circular front head plate 225 with tooth rows 217 at its front. A sliding O-ring seal 221 and a wiper 220 are installed in the barrel 228 with an end cap plate 226 attached to form sealed chambers 224/234 and a stopper 239 to limit the maximum stroke of the cylinder 210. The sliding seal 221 and the wiper 220 act to seal hydraulic fluid in the barrel 228 while permitting extension and retraction of the piston rod 223 with respect to the barrel 228. During an extension operation, hydraulic fluid 229 is pumped into the back chamber 224 through the back line 219, thus forcing the piston 222 forward. There are two types of retraction operation, as in a single-acting cylinder vs. a double-acting cylinder. During a single-acting cylinder's retraction operation, the piston is forced backward by a built-in spring. During a double-acting cylinder's retraction operation, hydraulic fluid 229 is pumped into the front chamber 234 through the front line 218 and, at the same time, the equal amount of hydraulic fluid is then pushed out of the back chamber 224 through the back line 219.

FIG. 3B illustrates the cross section view of the conventional hydraulic cylinder 210, shown in FIG. 3A, in a maximum extended position. Prior to an extension operation, both chambers 224/234 inside the barrel 228 shall be filled with hydraulic fluid 229. During the extension operation, hydraulic fluid 229 is pumped into the back chamber 224 through the back line 219, while the equal amount of hydraulic fluid 229 is pushed out of the front chamber 234 through the front line 218. The increased internal pressure will push forward the piston rod 223 with the front head plate 225 carrying the teeth 217 at its front surface.

FIG. 3C illustrates the cross section view of a conventional double-acting hydraulic cylinder 210, shown in FIG. 3A, in a fully retracted position. During the retraction operation, hydraulic fluid 229 is pumped into the front chamber 234 through the front line 218 and, at the same time, the equal amount of hydraulic fluid is then pushed out of the back chamber 224 through the back line 219.

Conventional hydraulic cylinders are widely employed in almost all industries including offshore industry. Conventional hydraulic cylinders, however, have some inherent disadvantages. Firstly, their fabrication cost is high, which accounts for the lion's share of a pile gripper's overall cost. Such high cost is closely related to the requirement of strict tolerance on precision machining. In addition, the fluid employed in hydraulic cylinders is usually an oil derivative and, therefore, expensive. In the application of submerged pile grippers, a large quantity of hydraulic fluid will be needed especially for deepwater application because of the long supply lines. Secondly, these cylinders are water depth dependent because the chamber pressure is always sealed off from the outside surroundings, and so the deeper into the sea, the higher the water pressure to be overcome. As water depth increases, the required internal pressure has to be increased accordingly, thus causing a considerable cost impact. Thirdly, the hydraulic fluids can, however, be an environmental hazard, in case of leakage, particularly when large quantities are used.

It is, therefore, desirable to provide a new type of hydraulic cylinder used for a pile gripper which does not employ pistons or sliding seals or rings, and therefore such cylinders can be manufactured with less strict tolerance at a lower cost. It is also desirable to provide a system that can employ inexpensive and environmentally friendly fluids, such as fresh water or seawater. It is further desirable to provide an active fluid power system with a built-in automatic retraction mechanism to eliminate the need for two fluid lines and two chambers as in the case of a double-acting cylinder. In short, an ideal new generation cylinder will need to be as powerful as, or even more powerful than, as conventional cylinders at a lower cost but with higher reliability.

OBJECTIVES AND SUMMARY OF THE INVENTION

The principal objective of the disclosure is to provide a new generation cylinder, which is more reliable because it does not use any wearing or damage prone sealing rings; safer and environmentally more friendly because it uses ordinary water like seawater or fresh water instead of oil for hydraulic fluid; and cheaper because it does not use a piston-driven power system which requires expensive strict tolerance precision machining, and also because it is basically maintenance free during its entire service life.

Another important objective of the disclosure is to have the fluid chamber of the new generation cylinder completely and reliably sealed off from the outside environment. Such sealing function is performed by the disclosed new configuration of elastomer annulus. Under the new design, the elastomer annulus of the cylinder is under tensile and compression dominant loading with little shear loading when under a maximum load bearing condition. In addition, the maximum tensile stress inside the bonded elastomer annulus is limited to a small and fixed degree and, in general, becomes independent of the maximum pressure undertaken. Therefore, the disclosed cylinder should be able to provide at least the same or higher load bearing capacity and better system reliability compared to a conventional hydraulic cylinder with the same cylinder O.D. size.

A still further important objective of the disclosure is to have a pistonless cylinder with a built-in automatic retraction mechanism to eliminate the need for two fluid lines, while needing only one line for extension action.

One more objective of the disclosure is that the introduced pistonless cylinder can be a submerged hydraulic cylinder independent of water depth, thus particularly suitable for offshore deepwater applications. Such independence is to be achieved by having a hydrostatic equilibrium inside the pistonless cylinder undersea prior to activation, namely, surrounding seawater can flow in and out of such cylinder chamber freely before the fluid line being closed and seawater being pumped into it. Furthermore, it also important to point out that such pistonless cylinders can be directly used for onshore applications as substitutes for most of conventional hydraulic/pneumatic cylinders in different industries.

A further objective of the disclosure is that the introduced pistonless cylinder shall be sturdy and durable either as a hydraulic or pneumatic cylinder, because the elastomer annulus, the key expandable element in the system, is made of mixtures of natural rubbers, which are proven to be sturdy and durable.

Another objective of this disclosure is to have a new type of cylinder with only one fluid chamber which is completely and reliably sealed off from the outside chambers without any possibility of leakage or seepage, so as to be able to achieve higher energy conversion rate. Conventional cylinders typically have more than one fluid chambers, and such chambers can never be completely sealed off because their pistons have to move back and forth into and out of these sealed chambers leaving traces of seepage or leakage, no matter how tight the sealing rings may be and how sophisticated the precision machining is.

In the disclosure, a new configuration for pistonless cylinders is introduced, which eliminates almost all the shear stress inside elastomer seals, and caps the tensile stress to a small and fixed degree without letting it go up along with the internal pressure increase for such seals. Therefore, eventually only compression stress remains and increases along with the internal pressure increase. It should be pointed out that any rubber structure is the most vulnerable to shear stress, while enjoying the highest resistance to compression stress, and to a less degree, to tensile stress. So, in most cases, failure of a rubber to metal bonded structure is caused by a rupture of the rubber close to the bonding surfaces due to shear stress, and the exact location of such rupture is unpredictable because hidden defects or faults may exist anywhere in the rubber for many different reasons. Elimination or significant reduction of shear stress will greatly enhance the reliability and force bearing capacity of the seals. Noticeably, failures of a pistonless power system, if any, will most likely not be caused by seal failure under high internal pressure, but only by cylinder's steel structural failure. In contrast, almost all of conventional cylinder failures are due to the failure of their sealing seals. Consequently, the disclosed pistonless cylinder potentially should enjoy much higher system reliability than conventional hydraulic cylinders.

Moreover, the disclosed load bearing system has considerable advantages vis-a-vis conventional load bearing systems, because it can be used directly for both hydraulic and pneumatic cylinders without any difference because of the completely and reliably sealed chamber. The basic functionality as a hydraulic load bearing device of both new and conventional systems still remains the same. However, in the case of pneumatic cylinders, the basic functionalities between the new and conventional cylinders are very different. Currently, a large number of conventional pneumatic cylinders employ a combined hydraulic/pneumatic system, at an increased cost, to utilize air pressure to push hydraulic fluid and then to utilize the hydraulic fluid to lubricate the sliding seals because these sliding seals need hydraulic fluid for basic functionality.

One more additional objective of this improved pistonless cylinder is that a pistonless cylinder's total weight can be significantly less than one comparable conventional cylinder with a similar size and a similar capacity. In addition, the pistonless cylinder weight increase is insensitive to the cylinder internal pressure increase.

A still further important objective of this improved pistonless cylinder is to have a pistonless cylinder being able to utilize a negative pressure induced suction force inside an extendable pressure chamber to provide the front head of the cylinder with an extra retraction distance in order to achieve a maximum stroke distance comparable to a conventional hydraulic cylinder, when the two have the same original cylinder length.

An improved configuration design of a pistonless cylinder is introduced herein. The key objective of this improved configuration pistonless cylinder design is to significantly reduce or totally eliminate the friction force outside of a pistonless cylinder pressure chamber between a barrel inner surface and the extendable pressure chamber outer surface. Because the basic principle of a pistonless cylinder is to have the pressure chamber completely and reliably sealed off from the outside environment without any relative sliding surfaces inside the pressured chamber and then all sliding surface induced friction forces then only occur outside of the pressured chamber between the extendable pressure chamber outer surface and the barrel inner surface. Therefore, it then becomes a critical issue how to significantly reduce or totally eliminate the friction force at the surface between the extendable pressure chamber outer surface and the barrel inner surface, in order to fully meet the above-mentioned objectives.

BRIEF DESCRIPTION OF THE DRAWINGS

The drawings described herein are for illustrating purposes only of selected embodiments and not all possible implementations, and are not intended to limit the scope of the present disclosure. For further understanding of the nature and objects of this disclosure reference should be made to the following description, taken in conjunction with the accompanying drawings in which like parts are given like reference materials, and wherein:

FIG. 2A illustrates an ISO cut-off section view of a prior art pile gripper with a driven pile;

FIG. 14C-1 illustrates one alternative wrapping pattern, different from the one shown in FIG. 14C, for coil-like Aramid fibers evenly spaced inside elastomer layers criss-crossing with each adjacent Aramid fiber layer at a small angle, where all fibers arranged into two different configurations, one single string or several ones woven together into a strip, in accordance with one embodiment;

DETAILED DESCRIPTION OF THE EMBODIMENTS

Before explaining the disclosure in detail, it is to be understood that the system and method is not limited to the particular embodiments and that it can be practiced or carried out in various ways.

A Conventional Marine Shock Cell

Figure 4A:
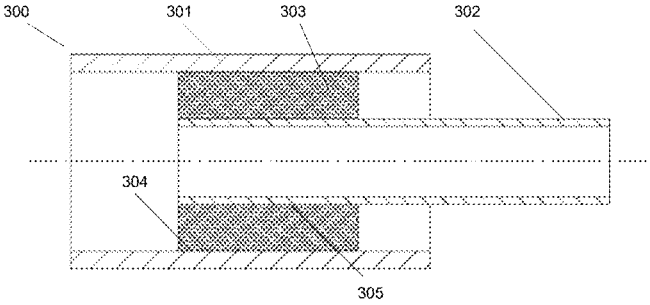
FIG. 4A (Prior Art)
FIG. 4A illustrates cross section view of a prior art marine shock cell in an unloaded condition.
Figure 4B:
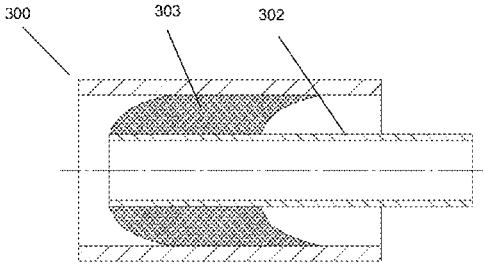
FIG. 4B (Prior Art)
FIG. 4B illustrates cross section view of a prior art marine shock cell in a compressed condition.
Figure 4C:
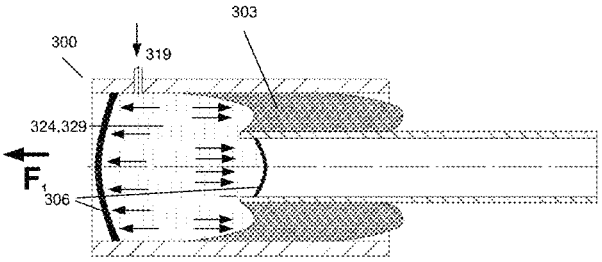
FIG. 4C (Prior Art)
FIG. 4C illustrates section view of a prior art marine shock cell in a condition with injected water as the medium inside a sealed chamber for power transmission.

A new type of hydraulic cylinder, called "pistonless cylinder," is disclosed in this invention. The principle of such pistonless cylinder is derived from offshore marine shock cells which, field tested and proven, have been successfully used, as maintenance-free apparatuses, in numerous offshore applications for decades. The general function of a marine shock cell is to passively absorb impact loads such as those induced during docking operations between a vessel and an offshore structure. As illustrated in FIG. 4A as, a typical marine shock cell 300 comprises an inner cylinder 302 and an outer cylinder 301 with a larger diameter. An elastomer annulus 303, which commonly uses mixtures of natural rubber to achieve better rubber to steel bonding characteristics, is bonded to the outer surface 305 of the inner cylinder 302 and the inner surface 304 of the outer cylinder 301 during a vulcanization process. When a compression force ($F_1$), as shown in FIG. 4B in a simplified cross section view, is applied at the front end of the inner cylinder 302, the shock cell 300 induces the deflection in the elastomer annulus 303 under shear dominant loading condition as illustrated in FIG. 4B. Once the force ($F_1$) is removed, the elastomer annulus 303 will automatically return to its original deflection free configuration as shown in FIG. 4A. Illustrated in FIG. 4C, once the chamber 324 becomes a sealed room by two elliptical heads 306 and a hydraulic force with pumped-in hydraulic fluid 329 through the line 319 can then be applied at the back of the two elliptical heads 306 as well as the inner surface of the elastomer annulus 303, and so such shock cell 300 will thus become a reactive load bearing fluid power system.

The manufacturing tolerance and overall fabrication costs of a shock cell are generally low. A shock cell is, however, a reactive device only for absorbing external energy input. Nevertheless, such shock cell also can become an active device to provide power output, as described in U.S. Pat. No. 6,427,577 to Lee et al., issued on Aug. 22, 2002. Said patent provides a detailed description of a new type of cylinder, or called expandable cylinder in the patent, in various configurations for various applications. However, in all the listed configurations in the patent, the elastomer annuli are all allowed to bulge out freely without any cap under high internal pressure loading, thus limiting the power output of such expandable cylinder due to the possibility of excessive bulging induced annulus failure. That is, specifically, because these elastomer annuli are under shear-dominant loading, especially near bonded surfaces, when bulging out excessively under high internal pressure. In addition, the maximum shear stress inside these elastomer annuli is related to the maximum pressure loading undertaken. It is common knowledge that elastomers, such as natural rubbers, generally have much better resistance to tensile or compression stresses than to shear stress. Therefore, the acceptable annulus maximum pressures are limited due to reliability concerns for those cylinder configurations listed in said patent.

In the current disclosure, a new configuration of cylinder is introduced, in which these elastomer annuli are under compression and tensile dominant loading with little shear loading. Moreover, the maximum tensile stress inside these elastomer annuli is capped to a small and fixed degree and, in general, is independent of the maximum pressure undertaken. Therefore, such newly configured cylinders are sturdier, more reliable, and safer, because they are able to take much higher internal pressure than those configurations in the above-mentioned patent.

Major Differences Between Pistonless and Conventional Cylinders

The disclosed pistonless cylinders are significantly different from conventional cylinders in the following areas:

1. A conventional cylinder uses a piston as its stroke to exert pushing/pulling force, while a pistonless cylinder moves its front outer cylinder forward and backward to do the same. Consequently, fabrication of a pistonless cylinder does not require expensive precision machining for piston and sealing ring or sliding surfaces of the cylinder.

2. The chamber of a conventional cylinder can never be completely sealed because its piston has to move back and forth and in and out of the chamber, thus causing traces of leakage or seepage no matter how tiny. In contrast, the chamber of a pistonless cylinder can be completely and reliably sealed with the help of mature and proven rubber to metal bonding technology. Therefore, a pistonless cylinder should be able to enjoy higher energy conversion efficiency.

3. Most of conventional hydraulic cylinders in actual usage can, currently, use only oil derivatives as their hydraulic fluids, while pistonless cylinders can use any ordinary liquids, like fresh water or seawater, as their hydraulic fluids. Consequently, a pistonless cylinder is much more environmentally friendly.

4. Conventional hydraulic and pneumatic cylinders are not interchangeable in terms of power transmission medium. By design, they can use only fluids or only air as their medium, but not interchangeably. In contrast, any pistonless cylinder can function as a hydraulic or pneumatic cylinder interchangeably without a need for any modification.

5. In offshore deepwater applications, the chamber of a pistonless hydraulic cylinder enjoys a hydrostatic equilibrium with the surrounding sea, because seawater can flow in and out of the chamber freely before the pumping action begins. As a result, its fabrication cost is independent of the depth of the sea. In contrast, the chamber of a conventional hydraulic cylinder has to be always sealed off from the surrounding sea for fear of hydraulic fluid leakage. As a result, its fabrication cost is sensitive to the depth of sea, particularly in terms of sealing rings.

Major Differences with the Expandable Cylinder in U.S. Pat. No. 6,427,577

The disclosed pistonless cylinder is mainly different from the expandable cylinders in U.S. Pat. No. 6,427,577 in the following areas:

1. A ring-shaped shim block or a ring-shaped shim plate with reduced thickness for greater stroke distance is inserted in the gap between the two outer cylinders primarily to convert the shear dominant stress into compression dominant stress during the bulging out of the elastomer annuli under internal pressure inside the chamber, and secondarily to cap the elongation of such seals on the inner surfaces of the two outer cylinders and on the sides of the shim block or a plate to a small and fixed degree. Also, importantly, since the two annuli are under equal compression force from directly opposite directions pushing them against the sides of the same rigid shim block or a plate, such compression force cancels out each other. Because most of the shear stresses are converted to compression stresses and the elongation force capped to a small and fixed degree, the elastomer annuli of a pistonless cylinder are much more reliable and capable of bearing much higher internal pressure than their counterparts in any expandable cylinder mentioned in the above-mentioned patent.

2. As a new feature of the pistonless cylinder, a pair of similar ring plates are added to the edges of the bonding surfaces between the end of the annuli at the inner surfaces of the outer cylinders. A large part of the annuli ends is bonded to these ring plate surfaces, which are designed primarily for taking tensile stresses, so that the shear stresses of the annuli bonding surfaces are mostly converted to tensile/compression stresses during the bulging out or elongation of the annuli under increased internal pressure. As a result, the elastomer annuli of a pistonless cylinder are more reliable than their counterparts in any expandable cylinders described in the above-mentioned patent.

FIGS. 5A-5F illustrate one embodiment of a typical pistonless cylinder assembly 410 fixed in a steel can (not shown) of a submerged pile gripper (not shown). The pistonless cylinder assembly 410 includes an extendable unit 400, a completely sealed and extendable chamber 424, a friction reduction system and a barrel 428.

Figure 2B:
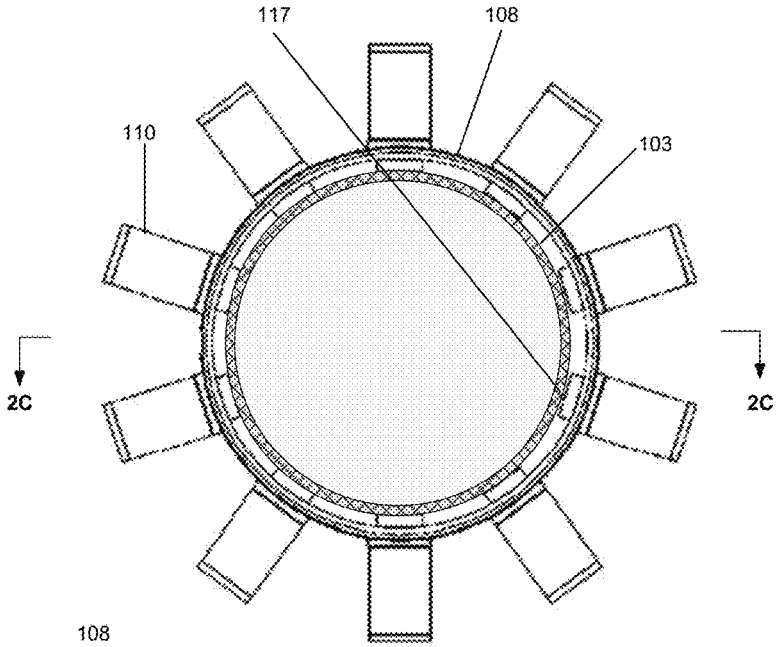
FIG. 2B (Prior Art)
FIG. 2B illustrates a top view of the prior art pile gripper.
Figure 2C:
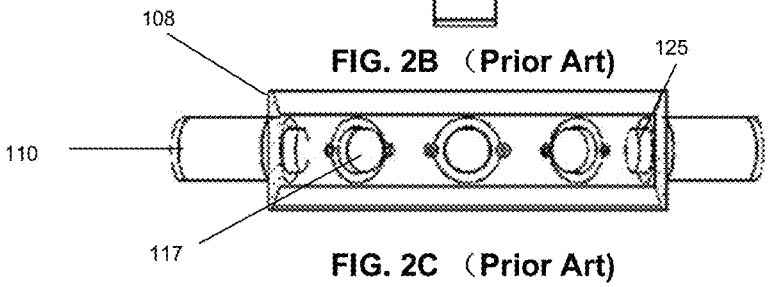
FIG. 2C (Prior Art)
FIG. 2C illustrates a cross-section view of the prior art pile gripper.
Figure 3A:
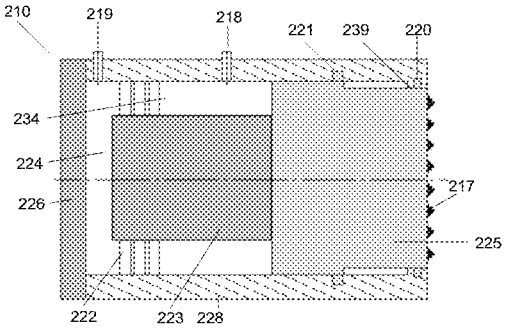
FIG. 3A (Prior Art)
FIG. 3A illustrates cross section view of a prior art hydraulic cylinder used for a conventional pile gripper prior to installation.
Figure 3B:
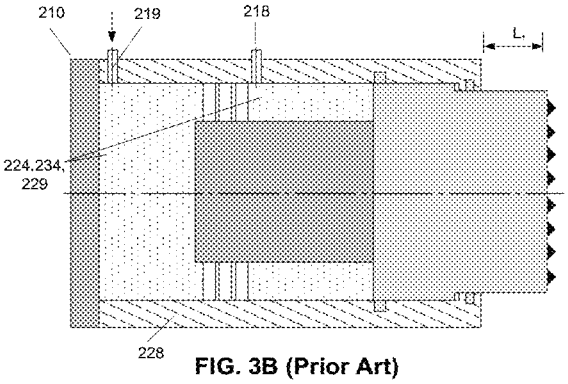
FIG. 3B (Prior Art)
FIG. 3B illustrates cross section view of a prior art hydraulic cylinder used for a conventional pile gripper during piston extension.
Figure 3C:
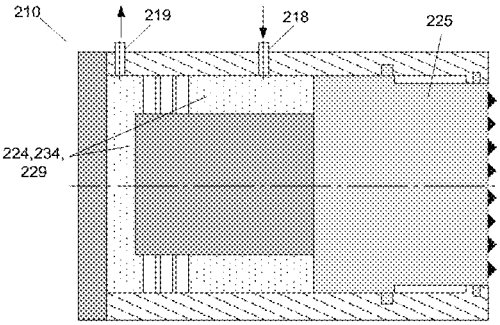
FIG. 3C (Prior Art)
FIG. 3C illustrates cross section view of a prior art hydraulic cylinder used for a conventional pile gripper during piston retraction.
Figure 5A:
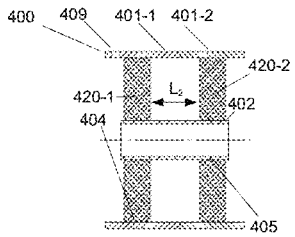
FIG. 5A illustrates a cross section view of an extendable unit of a pistonless cylinder with a uniform seal section for annuli according to one embodiment.
Figure 5B:
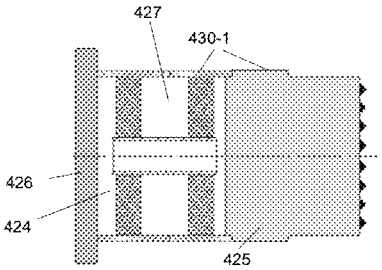
FIG. 5B illustrates a cross section view of a completely sealed and extendable chamber for a pistonless cylinder with a uniform seal section for annuli according to one embodiment.

As shown in FIGS. 5A-5B, the extendable unit 400 has two similar outer cylinders: one back outer cylinder 401-1 and one front outer cylinder 401-2. The back outer cylinder 401-1 has a hole 409 for the installation of a fluid line 419, which sits at the bottom of a barrel 428 against an end cap 426 without a need to make any movement. Noticeably, the front outer cylinder 401-2 connected with a front head 425 with tooth rows 417 is the only sliding part with sliding surfaces 430-1 and 430-2 of the entire pistonless cylinder 410, functioning as the stroke moving forward and backward. It is worthwhile to point out that unlike a conventional cylinder whose sliding surfaces are always inside a cylinder fluid chamber (FIG. 3B, 224), the sliding surfaces, 430-1 and 430-2, of the pistonless cylinder 410 is, in contrast, always outside of the fluid chamber 424.

Figure 5C:
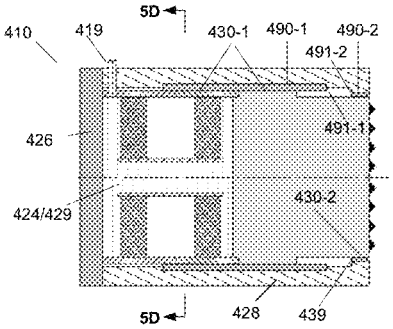
FIG. 5C illustrates a cross section view of a complete pistonless cylinder assembly including a friction reduction system, a completely sealed and extendable chamber and a barrel, with a uniform seal section for annuli prior to activation according to one embodiment.
Figure 5D:
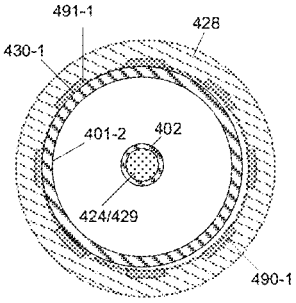
FIG. 5D illustrates a cross section view of the pistonless cylinder showing a plurality of plastic plates between metal to metal contacting surfaces and fixed via thread or gluing to the corresponding recesses on the inner surface of the barrel according to one embodiment.

As illustrated in FIGS. 5C-D, each set of friction reduction system at each of the two sliding surfaces has eight curved plastic plates, 490-1 or 490-2. These plastic plates, preferably using Ultra High Molecular Weight Polyethylene (UHMWPE) material, match the curvature of outer cylinder 401-2 outer diameter and the diameters of the front head 425. As illustrated in FIG. 5D, these plastic plates are evenly placed and fixed by thread or gluing in the corresponding recesses 491-1 and 491-2 on the inner surfaces of the barrel 428, for 490-1 and 491-1 at sliding surfaces of 430-1. The basic configurations are similar to 490-2 and 491-2 at the sliding surfaces of 430-2 with a reduced O.D. for the front head 425. These plastic plate surfaces are in contact with the steel sliding surfaces 430-1 and 430-2 of front outer cylinder 401-2 outer surface and/or front head 425 outer surfaces during cylinder extension and retraction actions. The UHMWPE has proven excellent anti-wearing and self-lubricant properties and a very good property to reduce noise during relative sliding with a steel surface. However, these plastic plates 490-1 and 490-2 are more suitable for on-land applications than subsea applications for pistonless cylinders.

As illustrated in FIG. 5C, the pistonless cylinder assembly 410 has an inner cylinder 402 with a smaller O.D. and with both ends open. The inner cylinder 402 performs two functions: a) to bond one end of the elastomer seals, 420-1 and 420-2, at its outer surface for complete sealing; and b) to allow passage of fluid 429 to fill out the entire chamber 424 evenly. A back cap 426 is connected to the bottom of the back outer cylinder 401-1, via welding or flanged connections, and a front head 425 with tooth rows 417 at front surface for gripping action, is connected to the front outer cylinder 401-2 in order to have a completely sealed and extendable chamber 424 as illustrated in FIG. 5B.

The completely sealed and extendable chamber 424, illustrated in FIG. 5C, is inside the two outer cylinders 401-1 and 401-2 and the inner cylinder 402. The chamber 424 holds pressurized fluid 429 as the medium for power transmission. It should be pointed out that any kind of fluid, fresh water, seawater, etc. can be used as the hydraulic fluid 429 except any oil-based fluid, because all oil derivatives are more or less detrimental to rubber or other rubber-based elastomers. Noticeably, water inside the chamber 424 also has some cooling effect to offset any potential heat-up of these annulus seals, 420-1 and 420-2. Moreover, the chamber 424 can be used directly for a pneumatic cylinder without a need for any modification, because the chamber 424 is completely and reliably sealed without any possibility of air leakage. It is worth noticing that a pistonless cylinder 410 has only one chamber 424, whereas conventional cylinders typically have two or more chambers.

The pair of elastomer seals 420-1 and 420-2 have the same and uniform cross section thickness. The function of the two elastomer seals, 420-1 and 420-2, is three fold: a) to completely seal off the fluid chamber 424 from the outside surroundings by bonding with the outside surface 405 of the inner cylinder 402 at one end and with the inner surface 404 of outer cylinders 401-1 and 401-2 at the other end; b) to help hold the inner cylinder 402 coaxially in the center of the chamber 424; and c) most importantly, to allow the unidirectional movement of the front outer cylinder 401-2 plus the front head 425 as a stroke via the elasticity of the elastomer seals, 420-1 and 420-2. It should be pointed out that once fluid 429 stops being pumped into the chamber 424, the inherent restoring force itself of these elastomer seals, 420-1 and 420-2, together with the pressure outside of the submerged cylinder 410, will pull/push the cylinder front head 425 backward to release the gripping action without a need for a front pumping line or an extra chamber. It is also worthwhile to note that the thickness of the elastomer seals, 420-1 and 420-2, will determine the amount of the built-in restoring force for retraction action of the pistonless cylinder 410. The distance $L_2$ is the distance between the two seals, 420-1 and 420-2, to form a cavity 427.

A fluid line 419 is installed through the fluid hole 409 at the back outer cylinder 401-1 for pumping fluid through the line 419 in and out of the chamber 424 and for controlling of the chamber extension and retraction speed through the pumping rate, during an extension action as well as for such fluid 429 being pushed/pumped out during a retraction action.

A barrel 428 housing all the above described components provides sliding surfaces 430-1 and 430-2 for the front outer cylinder 401-2 as the stroke as well as a stopper 439 to limit the front head 425 maximum stroke, and provides the protection and additional structural strength to the whole cylinder assembly 410.

In one embodiment, the chamber 424 of each cylinder assembly 410 of one pile gripper (not shown) is filled with water and then closed by a valve (not shown) at the line 419 inside one control assembly (not shown) prior to a jacket installation. Each supply line (not shown) is equipped with an opened valve (not shown) at the control assembly prior to the jacket installation. During the jacket offshore installation, seawater will automatically flow into the supply line up to the water surface 106, (FIG. 1) and the seals, 420-1 and 420-2, will not be bulged due to the closed and water sealed chamber 424. Prior to a jacket leveling operation, the valve at each line 419 is opened first and the internal hydrostatic pressure inside the chamber 424 will be equalized with the surroundings. The valve at each line 419 is then closed ready for the pistonless cylinder assembly 410 activation after the subsea opened valve for the supply line at the control assembly is closed to surroundings and the supply line is connected to the line 419. The portion of the supply line above water surface 106 will be filled with pumped water and a pump (not shown) at a platform top will then supply seawater to the chamber 424 of each cylinder assembly 410 for the engagement of teeth 417 inward toward a driven pile 403 outer surface for a gripping action. In a summary, the fluid line and the control assembly together perform two basic functions for a subsea gripping action: 1) making the completely sealed and extendable chamber able to be open and closed to surroundings and 2) pumping seawater into and out of the chamber. Based on the above-mentioned jacket installation procedures, the cylinder assembly 410 load bearing capacity is independent of the depth of sea.

Figure 5E:
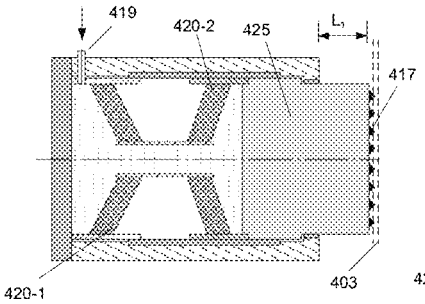
FIG. 5E illustrates a cross-section view of the pistonless cylinder in an initial extended configuration according to one embodiment.

FIG. 5E illustrates the pistonless cylinder assembly 410 in an extended position. Seawater 429 is pumped into the chamber 424 through the fluid line 419 to push the front outer cylinder 401-2 together with the cylinder front head 425 with tooth rows 417 forward, until its teeth 417 engages initially a driven pile 403 outer surface with a total travel distance at $L_1$. At this stage, the internal pressure is limited and the seals, 420-1 and 420-2, are mostly stretched with elongation induced tensile stresses and with a little bulging induced shear stresses.

Figure 5F:
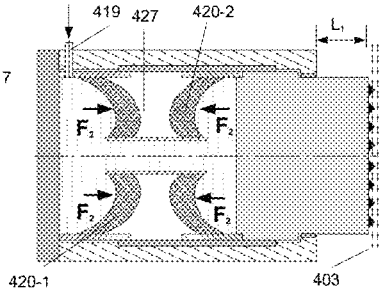
FIG. 5F illustrates a cross section view of the pistonless cylinder in a contraction position under a designed pressure according to one embodiment.

FIG. 5F illustrates the pistonless cylinder assembly 410 in a fully extended position. Seawater 429 is continuously pumped into the chamber 424 through the fluid line 419 to reach a designed internal pressure loading ($F_2$). At the same time, pressure loading ($F_2$) for both seals, 420-1 and 420-2, is equal but in the opposite direction toward each other, thus cancelling out each other. Under the designed pressure ($F_2$), the teeth 417 at the cylinder front head 425 surface deforms the pile 403 outer surface locally around the point of contact in order to perform the gripping action. The cavity 427 cross section shape, which is open to the surroundings through some holes in the barrel 428, is changed due to large bulging out of both seals, 420-1 and 420-2.

Figure 6A:
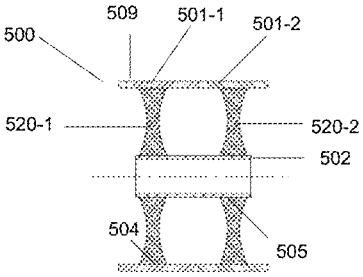
FIG. 6A illustrates a section view of an extendable unit of a pistonless cylinder assembly with a double-side-curved seal section at both sides according to one embodiment.
Figure 6B:
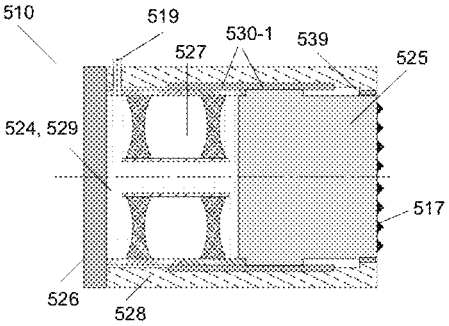
FIG. 6B illustrates a cross section view of a pistonless cylinder assembly with a double-side-curved seal section at both sides prior to activation according to one embodiment.

FIGS. 6A-6D depict the configurations and the load bearing functionality of a pistonless cylinder assembly 510 in accordance with another embodiment. In FIGS. 6A and 6B, all components of the assembly are the same as the ones in FIGS. 5A and 5B, except for the elastomer seals, 520-1 and 520-2, section configuration differences. In FIGS. 5A and 5B, the elastomer seals, 420-1 and 420-2, both have a uniform thickness across their entire length on both sides. In FIGS. 6A and 6B, the elastomer seals, 520-1 and 520-2, have a narrowed thickness at their centers across their height on both sides. Such centrally decreased thickness makes it easier for the elastomer seals, 520-1 and 520-2, to bulge.

Figure 6C:
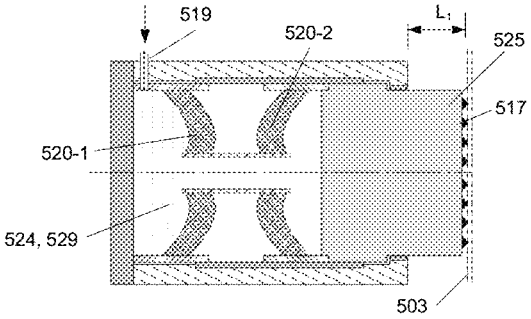
FIG. 6C illustrates a section view of a pistonless cylinder assembly with a double-side-curved seal section at both sides in an initial extended configuration according to one embodiment.

As illustrated in FIG. 6C, seawater 529 is pumped into the chamber 524 through the fluid line 519 to push the front outer cylinder 501-2 together with the cylinder front head 525 with tooth rows 517 forward, until its teeth 517 engages initially a driven pile 503 outer surface. The total travel distance is at $L_1$. At this stage, the internal pressure is limited and the seals, 520-1 and 520-2, have some more bulging due to the narrowed thickness at seal centers on both sides.

Figure 6D:
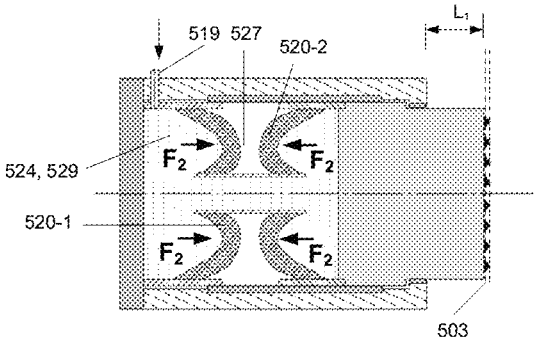
FIG. 6D illustrates a cross section view of a pistonless cylinder assembly with a double-side-curved seal section at both sides in a fully extended position under a designed pressure according to one embodiment.

As illustrated in FIG. 6D, seawater 529 is continuously pumped into the chamber 524 through the fluid line 519 to reach a designed internal pressure ($F_2$). At the same time, pressure loading ($F_2$) for both seals, 520-1 and 520-2, are equal but in the opposite direction toward each other, thus cancelling out each other. Under the designed internal pressure ($F_2$), the teeth 517 at the cylinder front head 525 surface deforms the driven pile 503 outer surface locally around the point of contact in order to perform the gripping action. The cavity 527 section shape is changed due to the excessive bulging of both seals, 520-1 and 520-2, because of the narrowed thickness of the seal cross sections, 520-1 and 520-2.

FIGS. 7A-7E depict the configurations and the load bearing functionality of a pistonless cylinder assembly 610 in accordance with yet another embodiment. The load bearing pistonless cylinder 610 comprises the same components as in FIGS. 6A-6D except for the followings differences:

1. Adding a pair of ring plates, 660-1 and 660-2, fixed at both outer cylinders 601-1 and 601-2 inner surfaces at the bonding surfaces 604 to have increased bonding areas. The purpose of such ring plates, 660-1 and 660-2, is to help convert the shear dominant stress into tensile dominant stress at the bonding surfaces 604 during the bulging out or elongation of the seals, 620-1 or 620-2. This objective is achieved by bonding a large part 604 of the elastomer seals, 620-1 or 620-2, to the ring plates 660-1 and 660-2 outer surfaces instead of bonding the entire seal ends to the inner surfaces of the outer cylinders, 601-1 and 601-2, only;

2. Adding one ring-shaped shim block 640, with a thickness $L_2$ and with its central hole connecting to the inner cylinder 602 outer surface, inserted between the two elastomer seals, 620-1 and 620-2, and outside of the sealed chamber 624. The purpose of such shim block 640 is to convert shear stresses to compression stresses and cap the tensile stress to a small and fixed degree during the bulging out of the seals, 620-1 and 620-2. This objective is achieved this way: the pair of elastomer seals, 620-1 and 620-2, have an identical cross-section with centrally decreased thickness on the one side and straight surface on the other side in order for both seals, 620-1 and 620-2, to make easy contact and conformation with the ring-shaped shim block 640 sides and the inner surface 604 of the outer cylinders, 601-1 and 601-2, so as to change a shear dominant loading condition into a compression dominant loading condition without bulging any further for both seals 620-1 and 620-2. This design is to make it easier for both seals 620-1 and 620-2 to be bulged out and closely conform to the shape of the sides of the shim block under a relatively low pressure loading, resulting in quick and effective conversion of shear stress to compression stress against the side surfaces of the shim block 640 and the inner surfaces of the outer cylinders 601-1 and 601-2, and also resulting in limitation of the tensile stress to a small and fixed degree without any further elongation for both seals 620-1 and 620-2. At this stage under or exceeding a designed internal pressure ($F_2$), the internal tensile stress increase and the shear stress increase inside the two annuli become independent of internal pressure increase. At the same time, pressure loading ($F_2$) for both seals, 620-1 and 620-2, is equal but in the opposite direction toward each other against both sides of the same shim block 640, thus cancelling out each other. The second and minor purpose of the shim block 640 is to hold the inner cylinder 602 coaxially in place at the center of the chamber 624. It is worth noticing that the thickness $L_2$ is the same as, or larger than, the maximum stroke distance $L_1$. It is also worth noticing that one more sliding surface 630-3 is created due to the addition of the shim block 640. Therefore, the similar friction reduction system, as the one for the outer cylinder 601-2 outer surfaces 630-1, is added for their contact surfaces 630-3 with eight curved plastic plates 690-3 fixed inside the corresponding recesses 691-3, as illustrated in FIG. 7B.

Figure 7A:
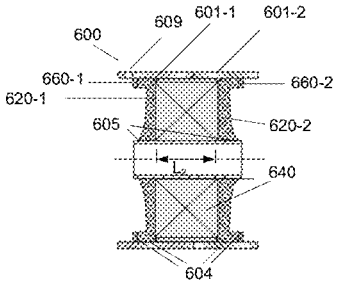
FIG. 7A illustrates a cross section view of an extendable unit of a pistonless cylinder with a one-side curved seal section, two added ring plates and one ring-shaped shim block in accordance with one embodiment.
Figure 7B:
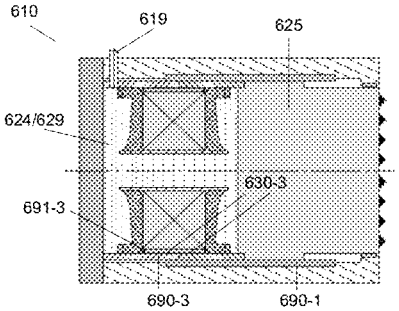
FIG. 7B illustrates a cross section view of a pistonless cylinder assembly with a one-side curved seal section, two added ring plates and one ring-shaped shim block prior to activation in accordance with one embodiment.
Figure 7C:
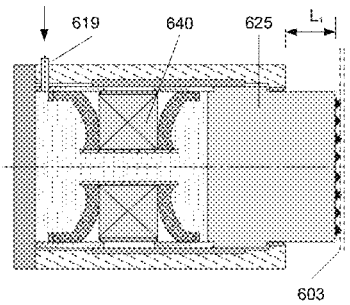
FIG. 7C illustrates a cross-section view of a pistonless cylinder assembly with a one-side curved seal section, two added ring plates and one ring-shaped shim block in an initial extended configuration in accordance with one embodiment.
Figure 7D:
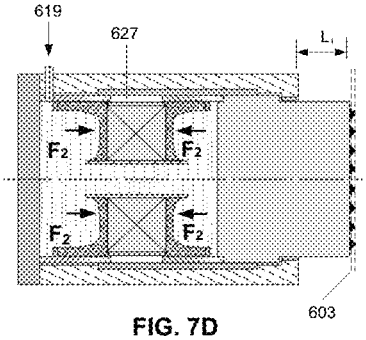
FIG. 7D illustrates a cross section view of a pistonless cylinder assembly with a one-side curved seal section, two added ring plates and one ring-shaped shim block under a designed pressure in accordance with one embodiment.
Figure 7E:
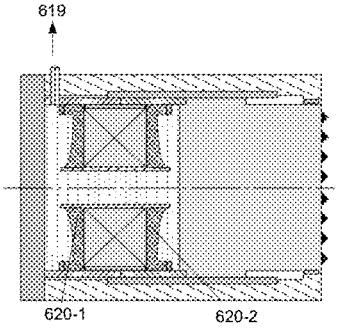
FIG. 7E illustrates a cross section view of a pistonless cylinder assembly with a one-side curved seal section, two added ring plates and one ring-shaped shim block in a retracted configuration in accordance with one embodiment.
Figure 8A:
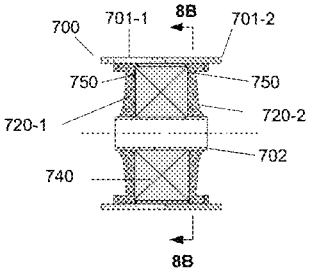
FIG. 8A illustrates a cross section view of an extendable unit of a pistonless cylinder with one bandage ring layer for local reinforcement at the outer side surface of each elastomer annulus against the ring-shaped shim block in accordance with one embodiment.
Figure 8B:
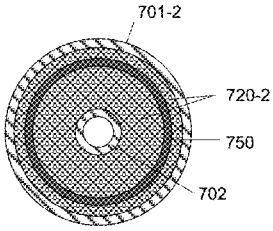
FIG. 8B illustrates a cross section view of a pistonless cylinder assembly with one bandage ring layer for local reinforcement at the outer side surface of each elastomer annulus against the ring-shaped shim block in accordance with one embodiment.
Figure 8C:
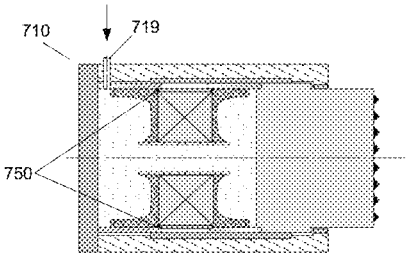
FIG. 8C illustrates a cross section view of a pistonless cylinder assembly with one bandage ring layer for local reinforcement at the outer side surface of each elastomer annulus against the ring-shaped shim block under a designed pressure in accordance with one embodiment.

In accordance with yet one embodiment, FIGS. 8A-8C depict a load bearing pistonless cylinder assembly 710 comprising the same set of components as in FIGS. 7A-7E except for the following differences:

1. FIGS. 8A-C depict a reinforced configuration to the configuration illustrated in FIGS. 7A and 7B.

2. Comparing FIG. 8A and FIG. 7A, only one bandage ring layer 750 are added for local reinforcement at the outer side surface of each elastomer annulus against the ring-shaped shim block 740 to form the extendable unit 700 in FIG. 8A. As illustrated by FIG. 8C for the complete cylinder assembly 710 under a designed internal pressure, these two bandage ring layers 750, with polyester fiber reinforcement, are moved to the corners where the bending stress can reach a maximum level.

3. FIG. 8B illustrates the cross section view in FIG. 8A to show the location of bandage ring layer 750 on the outer surface of seal 720-2.

Figure 9A:
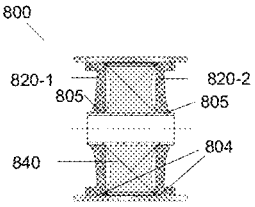
FIG. 9A illustrates a cross section view of an extendable unit of a pistonless cylinder with double-side-curved ring-shaped shim block in accordance with one embodiment.
Figure 9B:
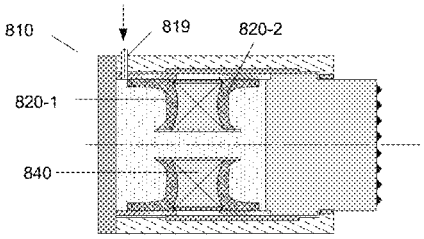
FIG. 9B illustrates a cross section view of a pistonless cylinder assembly with double-side-curved ring-shaped shim block under a designed pressure in accordance with one embodiment.

In another embodiment as illustrated in FIGS. 9A-9B, both sides of the shim block 840 can be curved in order to avoid any sharp corner, between the top of the shim block 840 and the outer cylinder inner surfaces 804 plus the shim block 840 and the inner cylinder outer surface 805, induced local build-up of stresses as well as to facilitate complete conformation of the contacting surfaces of the annuli, 820-1 and 820-2, with the sides of the shim block 840.

Figure 10A:
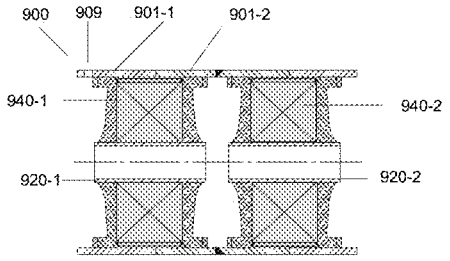
FIG. 10A illustrates a cross section view of a pistonless cylinder assembly with two pistonless cylinder extendable units connected together horizontally in a series to increase its overall stroke distance in accordance with one embodiment.
Figure 10B:
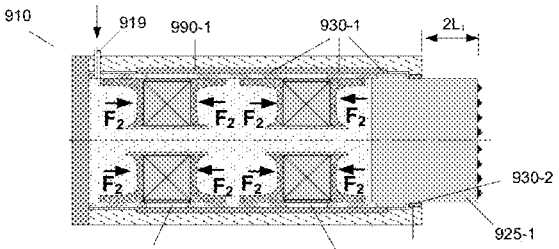
FIG. 10B illustrates a cross section view of a pistonless cylinder assembly with two pistonless cylinder extendable units connected together horizontally in a series to increase its overall stroke distance under a designed pressure in accordance with one embodiment.

In accordance with one embodiment, FIGS. 10A-B depict an alternative configuration by connecting two pistonless cylinder extendable units together as a combined unit 900 horizontally in a series to the configuration as one extendable unit of the pistonless cylinder 910 illustrated in FIG. 10A. Illustrated in FIG. 10B, the complete cylinder assembly 910 is under a designed internal pressure and the total stroke distance can be increased to $2L_2$.

Figure 11A:
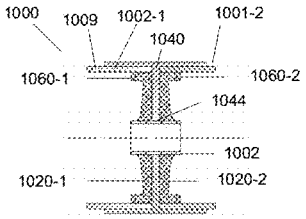
FIG. 11A illustrates a cross section view of a pistonless cylinder assembly with one added tubular with a larger O.D. than both outer cylinder O.D., and connecting the middle of the tubular inner surface with the upper surface of one ring-shaped shim plate between two elastomer seals, and with its other end connected to the middle of outer surface of the inner cylinder, shown as a T-shape section in order to increase its overall stroke distance with a less cylinder overall length in accordance with one embodiment.
Figure 11B:
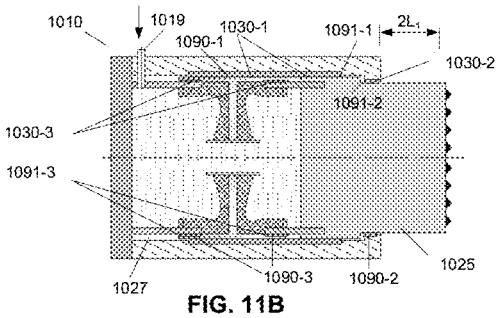
FIG. 11B illustrates a cross section view of a pistonless cylinder assembly with one added tubular with a larger O.D. than both outer cylinder O.D., and connecting the middle of the tubular inner surface with the upper surface of one ring-shaped shim plate between two elastomer seals, and with its other end connected to the middle of outer surface of the inner cylinder, shown as a T-shape section in order to increase its overall stroke distance with a less cylinder overall length under a designed pressure in accordance with one embodiment.

In accordance with one embodiment, FIGS. 11A-B depict an alternative configuration to increase the cylinder 1010 total stroke distance from $L_2$ to $2L_2$ By adding one shim ring plate 1040 in a T-shaped section configuration including one tubular with a larger O.D. than the outer cylinder O.D., 1001-1 and 1001-2 and one vertical ring plate at the middle of the tubular. The ring plate upper end is fixed to the tubular of the shim ring plate 1040, whose inner wall functions as the sliding surfaces, 1030-3, for these outer cylinders 1001-1 and 1001-2, and the lower end of the vertical ring plate is fixed at the middle of the inner cylinder 1002 outer surface 1044.

Under this configuration, the primary sliding surfaces 930-1 and 930-2 in one location, shown in FIG. 10B, are switched to two locations: 1) between the outer surfaces of cylinders, 1001-1 and 1001-2, and the tubular inner surfaces 1030-3 with the curved plastic plates 1090-3 inside corresponding recesses 1091-3 at tubular inner surfaces; 2) between the inner surface of the barrel and the tubular outer surface 1030-1, with the matching curved plastic plates 1090-1 inside corresponding recesses 1091-1 at the inner surface of the barrel, shown in FIG. 11B. The secondary sliding surface 1030-2 are between the front head 1025 outer surface and the curved plastic plates 1090-2 inside corresponding recesses 1091-2, shown in FIG. 11B. The reduced thickness of the shim plate 1040 helps to increase the cylinder 1010 overall stroke distance to $2L_2$, with a less cylinder overall length compared with the embodiment listed in FIGS. 10A-10B. Under this configuration, the elastomer annuli are elongated more with higher tensile stresses for both seals, 1020-1 and 1020-2, compared with the ones shown in FIG. 10B. However, the mixtures of natural rubber can be elongated over 400% of its original length without failure and the elongation shown herein is much below this threshold. It is worth noticing that the fixation between the shim plate 1040 central hole of the vertical ring plate and the middle of the inner cylinder 1002 outer surface can be a welded connection 1044 as a part of molding process prior to a vulcanization process, and kept as a part of the final assembly 1010 in one embodiment. In another embodiment, the whole ring-shaped shim plate in a T-shaped section configuration 1040 is made of plastic plates such as UHMWPE plates so that all plastic plates, 1090-1, 1090-2 and 1090-3, and corresponding recesses, 1091-1, 1092-2 and 1093-3, can be eliminated.

In accordance with one embodiment of the present disclosure, FIGS. 12A-F depict the installation procedure of a ring-shaped shim block 1140.

As illustrated in 12A, the configuration is similar to the one shown in FIG. 7A except for omission of a ring-shaped shim block 1140.

Figure 12A:
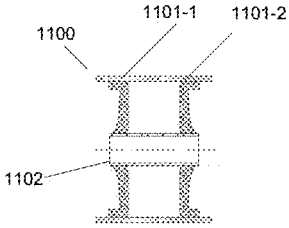
FIG. 12A illustrates a cross section view of the installation procedure of a ring-shaped shim block with an extendable unit configuration similar to the one shown in FIG. 7A except for omission of a ring-shaped shim block in one embodiment.
Figure 12B:
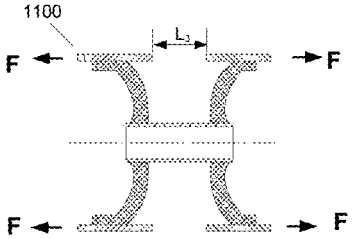
FIG. 12B illustrates a cross section view of the installation procedure of a ring-shaped shim block with pulling forces at each end of the extendable unit in one embodiment.

Referring now to FIG. 12B, pulling forces (F) are applied at each end of the pistonless cylinder key unit 1100 to create an open width $L_3$ which is larger than the shim block thickness $L_2$.

Figure 12C:
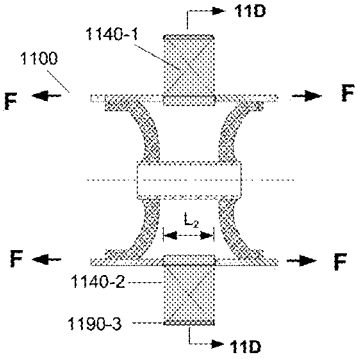
FIG. 12C illustrates a cross section view of the installation procedure of a ring-shaped shim block by dividing one ring-shaped shim block into a pair of identical parts for the installation and the moving action steps during the installation in one embodiment.

As illustrated in FIG. 12C, the ring-shaped shim block 1140 is divided into a pair of two identical parts for easy installation as 1140-1 and 1140-2. Both parts, 1140-1 and 1140-2, are installed through the opening $L_3$, part 1140-1 moving downward and part 1140-2 upward. Both parts, 1140-1 and 1140-2, of the shim block 1140 can be made of steel or less rigid materials such as plastics or hard rubbers. The less rigid materials can be utilized to facilitate complete conformation of the bulged elastomer seals to the sides of the shim block under high internal pressure. It is also possible, as in another embodiment, the shim block 1140 can be fixed to the middle of the inner cylinder 1102 outer surface during prefabrication molding as an integrated component of the inner cylinder.

Figure 12D:
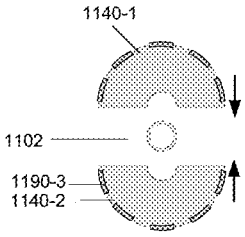
FIG. 12D illustrates a cross section view of the installation procedure of a ring-shaped shim block shown in FIG. 12C in one embodiment.

Referring to FIG. 12D, a cross section view of the moving action as depicted in FIG. 12C.

Figure 12E:
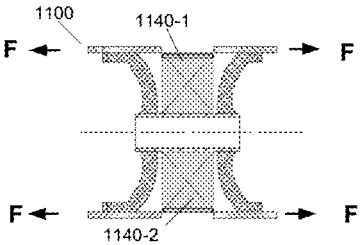
FIG. 12E illustrates a cross section view of the installation procedure of a ring-shaped shim block for the fixation between the installed shim block parts and the extendable unit in one embodiment.

As illustrated in FIG. 12E, as both parts, 1140-1 and 1140-2, are fully engaged with each other vertically, outer circumferential wrappings with several steel wires at the outer surface of the ring-shaped shim block 1140 can be used to connect both parts 1140-1 and 1140-2 together, or using gluing process at contact surface to connect the two parts together.

Figure 12F:
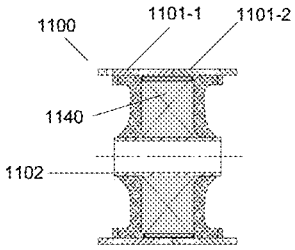
FIG. 12F illustrates a cross section view of the installation procedure of a ring-shaped shim block in a final installed configuration in one embodiment.

Referring to FIG. 12F, with slowly reduced pull force (F), the assembly process for the installation of the ring-shaped shim block 1140 is complete and the load bearing pistonless cylinder unit 1100 is then ready for the complete assembly. It is worth noticing that the shim block 1140 installation procedure can be used as the removing procedure for a mold shim block during a post vulcanization process.

In accordance with one embodiment of the present disclosure, figures from FIG. 13A through FIG. 13D illustrate key configurations of the improved version of a pistonless cylinder assembly with an installed friction reduction device and a radial pressure restrained device inside an elastomer tubular, both in a pre-activation position and in a fully extended position.

Based on the basic friction force calculation formula, $F=N\times f$, where, F is the total friction force, N is the total compression force at the contact surface, and f is the friction coefficient of the contact surface. Therefore, the intended friction reduction device shall do both: 1) utilizing a radial pressure restrained device to reduce the contact compression force at the contact surface. In other words, the contact pressure force from elastomer tubular outer surface should be significantly reduced compared with the pressure force acting at the elastomer inner surface; and 2) utilizing a friction reduction device by changing contact sliding surface property from a rubber-to-steel contact surface to a plastic-to-plastic contact surface with a significantly reduced friction coefficient at the sliding surface.

Figure 13A:
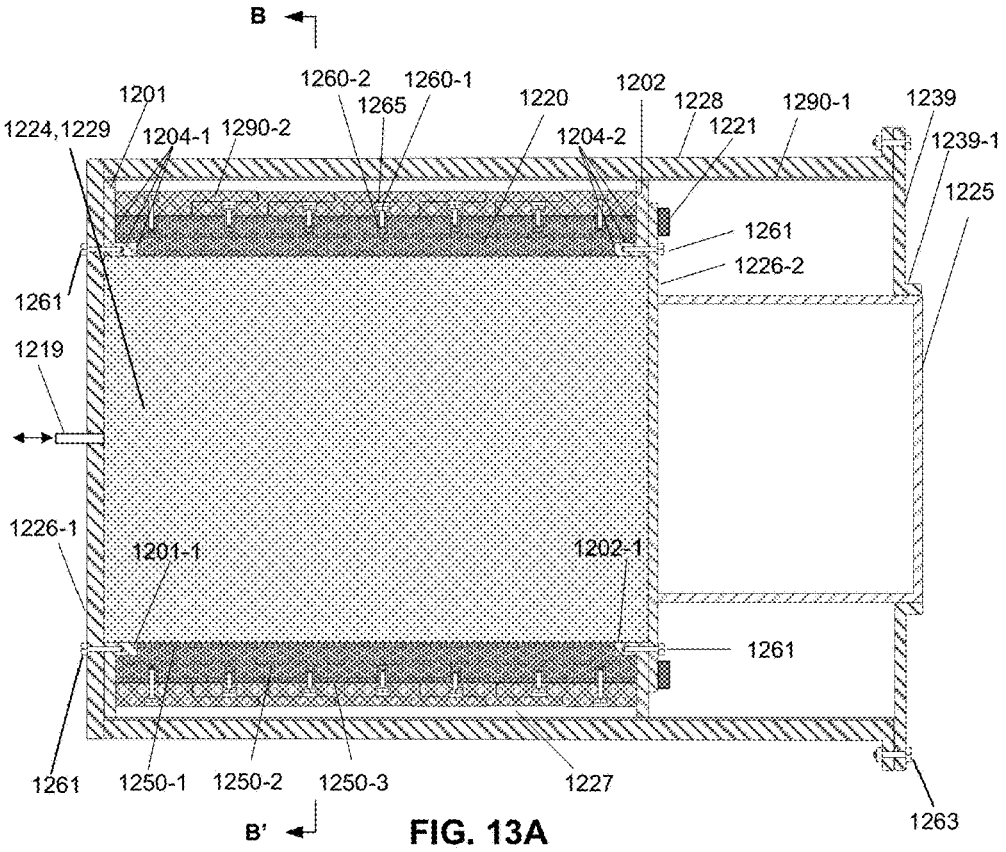
FIG. 13A illustrates a cross section view of the improved configuration design of a pistonless cylinder assembly in a pre-activation position in accordance with one embodiment.

Referring to FIG. 13A, the cross section view shows the basic configuration of a pistonless cylinder assembly. The cylinder can be assembled in the following steps in accordance with one embodiment:

1. A pair of ring plates 1201 and 1202 with horizontal shorter arm of the L-shape cross section 1201-1 and 1202-1 are connected to the two ends of an elastomer tubular 1220 through a vulcanization process to form bonded connections 1204-1 and 1204-2. A plurality of short steel pipes with closed bottoms, each with a pre-installed nut 1260-2 inside, are buried and bonded with rubber material inside the elastomer tubular 1220 near the tubular outer surface during the vulcanization process.

2. A radial pressure restrained device comprises a plurality of Aramid fiber layers 1250-1, 1250-2 and 1250-3, each layer placed between two thin rubber layers. Each Aramid fiber layer is composed of one single continuous string of Aramid fiber wrapped in a coil-like pattern around an annular thin rubber layer surface of the elastomer tubular 1220 from one end to the other end with a designed offset relative to the adjacent layer of Aramid fibers above or below. The bonding process between the Aramid fibers and the rubber layers is through the same vulcanization process as mentioned above.

3. A friction reduction device is made of a plurality of curved UHMWPE plates 1290-2 with one plate being able to slide at the surface of another plate both longitudinally and annularly. There is no gap between any two UHMWPE plates 1290-2 in longitudinal and annular directions in a pre-activation position. Each UHMWPE plate 1290-2 has one circular recess 1260-1 used for housing the bolting 1265 connection with one buried nut 1260-2 inside the elastomer tubular 1220, which has an outer surface curvature matching the UHMWPE tubular 1290-1 inner surface and an inner surface curvature matching the elastomer tubular 1220 outer surface. With the installation of the radial pressure restrained device and the friction reduction device in the assembled elastomer tubular 1220, it forms a unidirectionally extendable unit as the key power transmission element of the pistonless cylinder.

4. A barrel 1228 is pre-connected with an end cap plate 1226-1, which has a pre-installed supply pipe 1219, and then a UHMWPE tubular 1290-1 is inserted inside the barrel 1228 for friction reduction purpose. A front cap plate 1226-2 is connected with a pre-installed rubber ring plate 1221 and a front head 1225. A traveling control system for the front head 1225 comprising: 1) a ring plate 1239 with a L-shape cross section 1239-1 as a guide for the front head 1225 front extension and retraction; and 2) an installed rubber ring plate 1221 in combination with the ring plate 1239 to serve as a stopper for the maximum stroke distance of the unidirectional extendable tubular.

5. The final assembly of the pistonless cylinder is in the following order in accordance with one embodiment: 1) insert the unidirectionally extendable unit inside the barrel 1228 until one end touches the end cap plate 1226-1; 2) utilize a plurality of bolted connections 1261 to form a sealed connection between the end cap plate 1226-1 and the ring plate 1201; 3) utilize a plurality of bolted connections 1261 to form a sealed connection between the front plate 1226-2 and the ring plate 1202; and 4) finally, utilize a plurality of bolted connections 1263 to connect the ring plate 1239 with the barrel 1228 front end to form a completely sealed and unidirectionally extendable chamber 1224 with transmission medium 1229 to fill the chamber 1224. The final assembly shall have a designed annular gap 1227 between the UHMWPE plates 1290-2 outer surface and the UHMWPE tubular 1290-1 inner surface to provide a radial space for the potential radial expansion of the completely sealed extendable chamber. The installed supply pipe 1219 is connected to an external device for injection and withdrawal of the transmission medium 1229 inside the chamber 1224. If the transmission medium 1229 is air injected by an air compressor, the pistonless cylinder then becomes a pneumatic cylinder. If the transmission medium is water injected by a pump, then the pistonless cylinder is a hydraulic cylinder.

UHMWPE plate has excellent properties for anti-wearing and for providing low friction coefficient, as mentioned earlier. Therefore, it is ideal to use it as the basic material for the friction reduction device.

Aramid fiber layers 1250-1, 1250-2 and 1250-3 can be easily bonded with nature rubbers during a vulcanization process. In addition, Aramid fibers also have exceptionally good properties in anti-tension stress and anti-shear stress. With tension stress, an Aramid fiber is much stronger in performance than a steel fiber when the two have the same O.D. size as evidenced by the fact that Aramid fibers can be used for fabrication of a bulletproof vest. When used for the radial pressure restrained device, Aramid fiber layers 1250-1, 1250-2 1250-3 bonded with nature rubber layers enable the elastomer tubular 1220 to only have a unidirectional elasticity, that has a low longitudinal stiffness for easy extension of the elastomer tubular 1220 just like natural rubber on the one hand, and exceptionally high stiffness in radial direction as tightly restrained by the coil-like Aramid fiber layers in order to force an omni-directionally expandable pressure chamber to become a unidirectionally extendable pressure chamber.

Figure 13B:
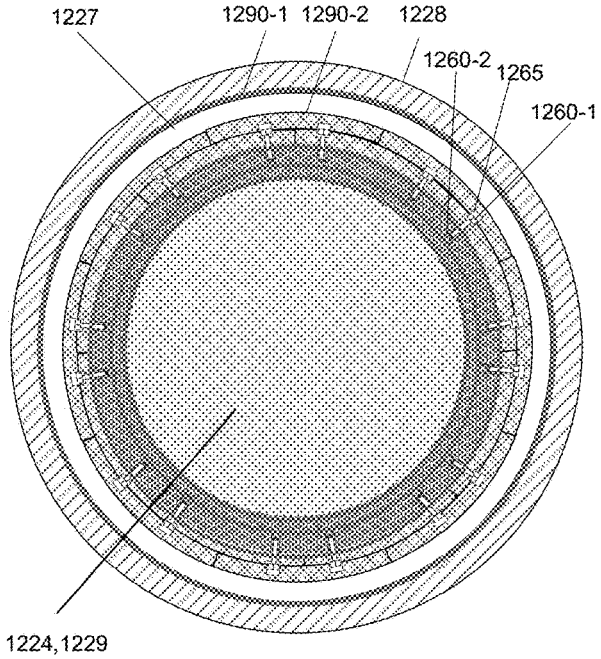
FIG. 13B illustrates the B-B' cross section view, shown in FIG. 13A, of the improved configuration of the pistonless cylinder assembly in a pre-activation position, in accordance with one embodiment.

Referring to FIG. 13B, a B-B' cross section view shown in FIG. 13A with the pistonless cylinder in a pre-activation position. There is no longitudinal gap between any two UHMWPE plates 1290-2.

Figure 13C:
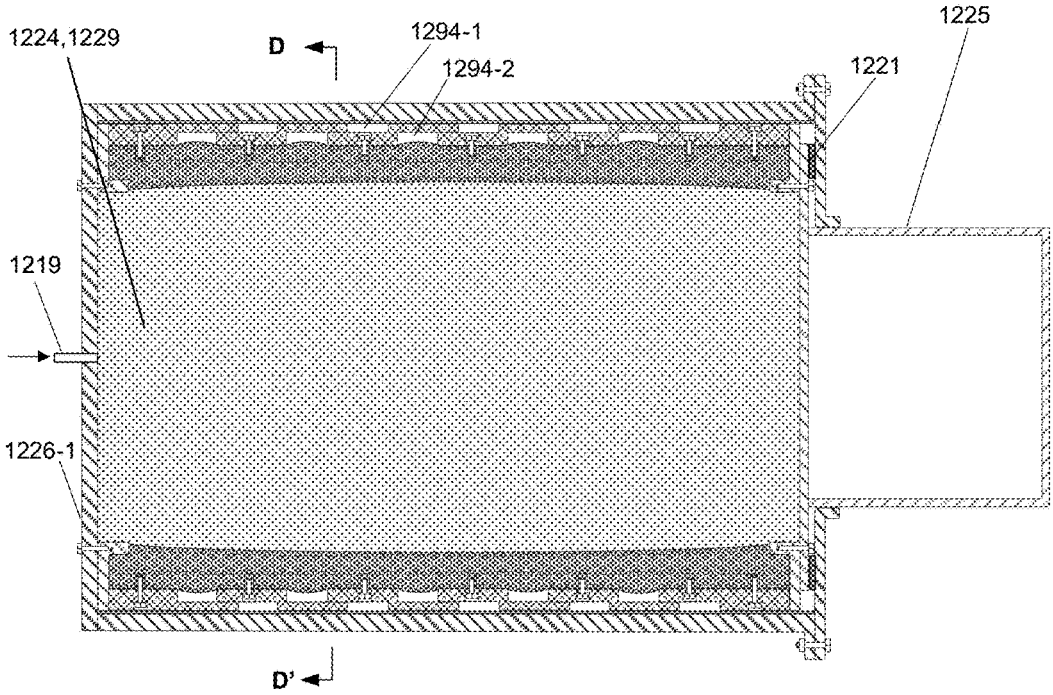
FIG. 13C illustrates a cross section view of the improved configuration design of a pistonless cylinder assembly in a fully extended position in accordance with one embodiment.

Referring to FIG. 13C, a cross section view to show the pistonless cylinder in a fully extended position. There are longitudinal gaps 1294-1 and 1294-2 between any two UHMWPE plates 1290-2 due to the elastomer tubular longitudinal expansion.

Figure 13D:
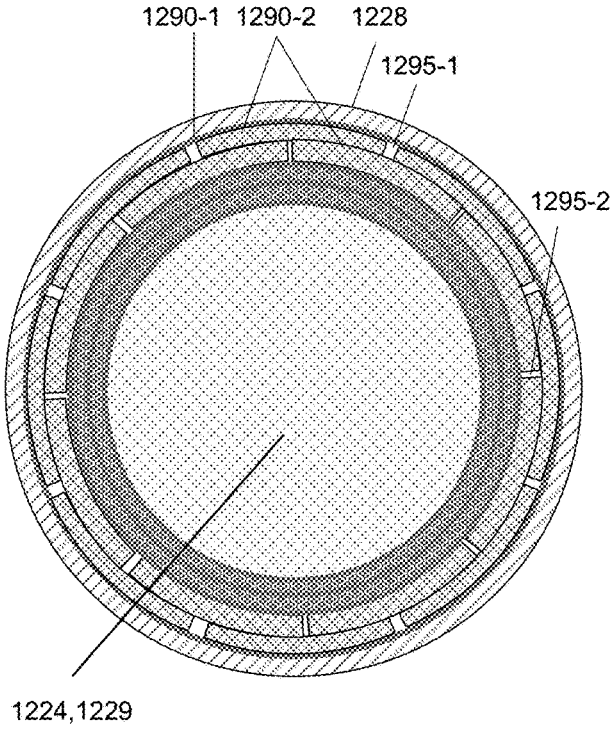
FIG. 13D illustrates the D-D' cross section view, shown in FIG. 13C, of the improved configuration of the pistonless cylinder assembly, in a fully extended position, in accordance with one embodiment.

Referring to FIG. 13D, a D-D' cross section view shown in FIG. 13C with the pistonless cylinder in a fully extended position. There are annular gaps 1295-1 and 1295-2 between any two UHMWPE plates 1290-2 due to the elastomer tubular radial expansion.

In accordance with one embodiment of the present disclosure, figures from FIG. 14A through FIG. 14D illustrate key variants of the improved configuration of a preferred pistonless cylinder assembly which is similar to the one shown in FIG. 13A, except for deletion of the friction reduction device, thus being the optimal approach to further simplify the whole system. In addition, different Aramid fiber coil-like wrapping patterns are introduced in accordance with one embodiment.

Figure 14A:
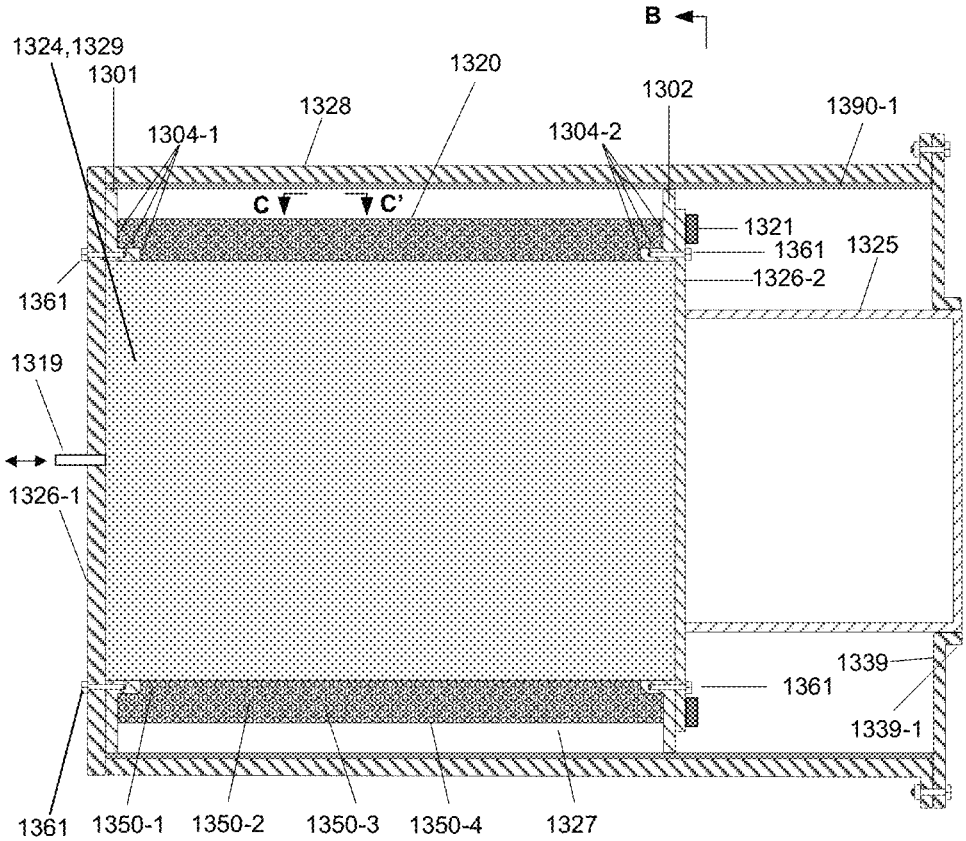
FIG. 14A illustrates a cross section view of a pistonless cylinder assembly configuration in a pre-activation position, similar to the one shown in FIG. 13A with such changes as deletion of the friction reduction device, except for a plastic tubular against the barrel inner surface for the friction reduction purpose, increase of the annular gap width and enhancement of the radial pressure restrained device in order to avoid any contact between the elastomer tubular outer surface and the barrel inner surface in accordance with one embodiment.

FIG. 14A illustrates a cross section view of a pistonless cylinder assembly configuration in a pre-activation position, similar to the one shown in FIG. 13A with such changes as deletion of the friction reduction device, increase of the annular gap width 1327, which is open to surroundings, and enhancement of the radial pressure restrained device with one additional Aramid fiber layer 1350-4 in addition to Aramid fiber layers 1350-1, 1350-2, and 1350-3 inside the elastomer tubular 1320 in order to avoid any contact between the elastomer tubular 1320 outer surface and the UHMWPE tubular 1390-1 inner surface under the maximum designed internal pressure in accordance with one embodiment.

Figure 14B:
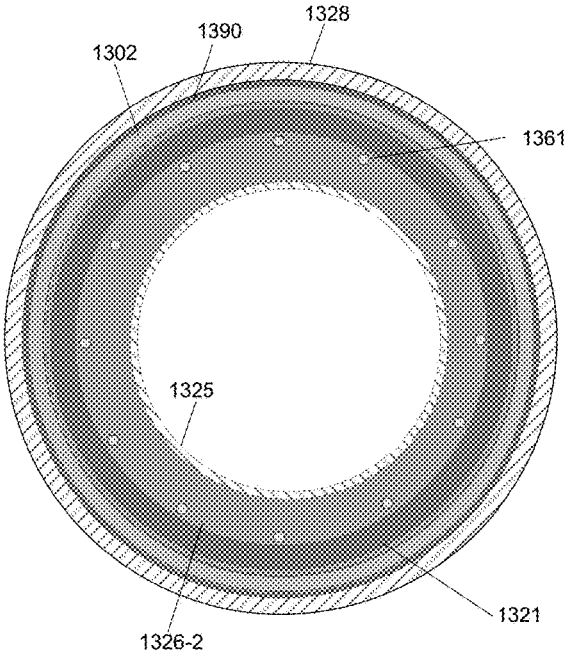
FIG. 14B illustrates the B-B' cross section view of the pistonless cylinder assembly, without a friction reduction device, shown in FIG. 14A and in a pre-activation position, in accordance with one embodiment.

Referring to FIG. 14B, a B-B' cross section view shown in FIG. 14A with the pistonless cylinder in a pre-activation position. There are 12 bolts 1361 used to connect the front plate 1326-2 and the ring plate with a L-shape section 1302 to form a sealed connection and to form a completely sealed and unidirectionally extendable chamber in accordance with one embodiment.

Figure 14C:
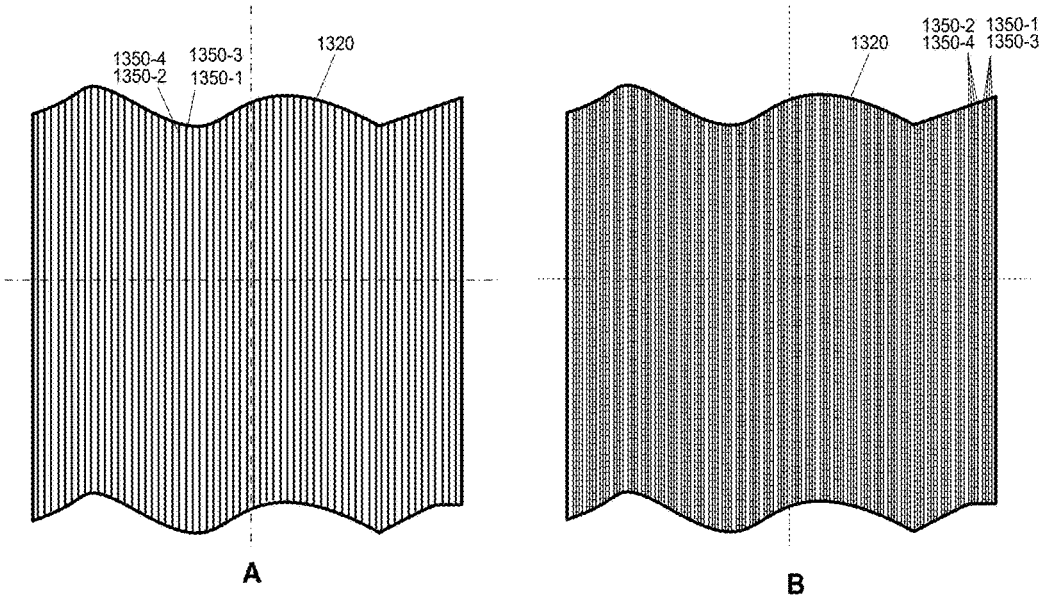
FIG. 14C illustrates the enlarged C-C' cut-off section view in FIG. 14A to show a basic coil-like wrapping pattern of Aramid fibers, which are evenly spaced inside an elastomer layer with each layer in a parallel configuration with a designed small offset relative to adjacent fiber layer above or below, where all fibers arranged into two different configurations, one single string or several ones woven together into a strip, in accordance with one embodiment.
Figures 1, 14C:
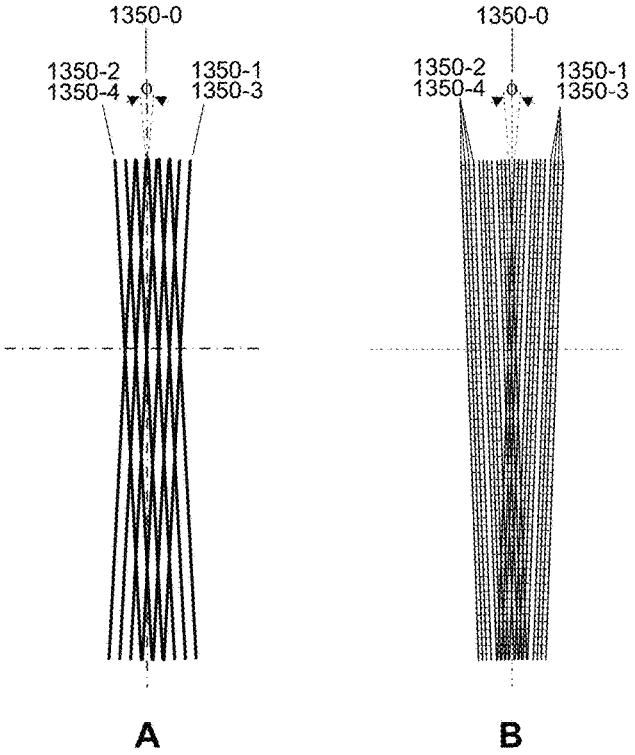
FIG. 1 illustrates an elevation view of a prior art offshore platform during offshore installation with a plurality of installed pile grippers.

There are two different coil-like wrapping patterns for an Aramid fiber layer around an annular rubber layer surface of the elastomer tubular 1320, as described separately in FIG. 14C and FIG. 14C-1. There are three critical objectives in selecting a proper wrapping pattern to suit each different application: 1) to minimize bulging and prevent leakage from the rubber between Aramid fibers within the same Aramid fiber layer, especially in a fully extended position of the elastomer tubular; 2) to best control the stiffness distribution of the elastomer tubular both in longitudinal direction and in radial direction; and 3) the wrapping pattern able to provide a good bonding characteristic between each Aramid fiber and nature rubber during a vulcanization process, in accordance with one embodiment.

Referring to FIG. 14C, this wrapping pattern is called the parallel pattern where all fibers, one single string in FIG. 14C-A or several ones woven together into a strip in FIG. 14C-B where four strings woven together into a strip, are wrapped in a parallel configuration not only in the same Aramid fiber layer, but also in the adjacent Aramid fiber layers above or below. However, all the Aramid fiber layers should be arranged in such a way that the Aramid fibers of each layer will cover the gaps with a designed offset between the Aramid fibers of the adjacent layers above or below. Therefore, such configuration will help minimize bulging of the rubber as well as the risk of leakage, while ensuring maximum elasticity in the longitudinal direction. It should be pointed out that several Aramid fiber strings woven into a wider strip will make it harder for such strip to slip out of the rubber layer bonded with.

Referring to FIG. 14C-1, this wrapping pattern is called the small-angle crisscrossing pattern where all fibers, one single string in FIG. 14C-1-A or several ones woven together into a strip shown in FIG. 14C-1-B where four strings woven together into a strip, in each Aramid fiber layer is arranged with a small angle 1350-0 relative to the adjacent Aramid fiber layer above or below. In other words, Aramid fibers in one layer will crisscross at a small angel (usually less than 8 degrees) with those in the adjacent layers. Such configuration will prevent any bulging or leakage of the rubber, while adding a little stiffness in the longitudinal direction.

Alternative material such as one single string of steel wire or several ones connected together into a strip to replace the Aramid fibers, can be wrapped both in the parallel configuration and a small-angle crisscrossing pattern mentioned above. In the tire industry, bonding steel wires or steel nets inside a rubber tire has become a common practice with advanced steel wire to natural rubber bonding technologies. The same technology can be utilized for the pistonless cylinders as the radial pressure restrained device, using steel wires to replace Aramid fiber in the applications, in accordance with one embodiment.

Figure 14D:
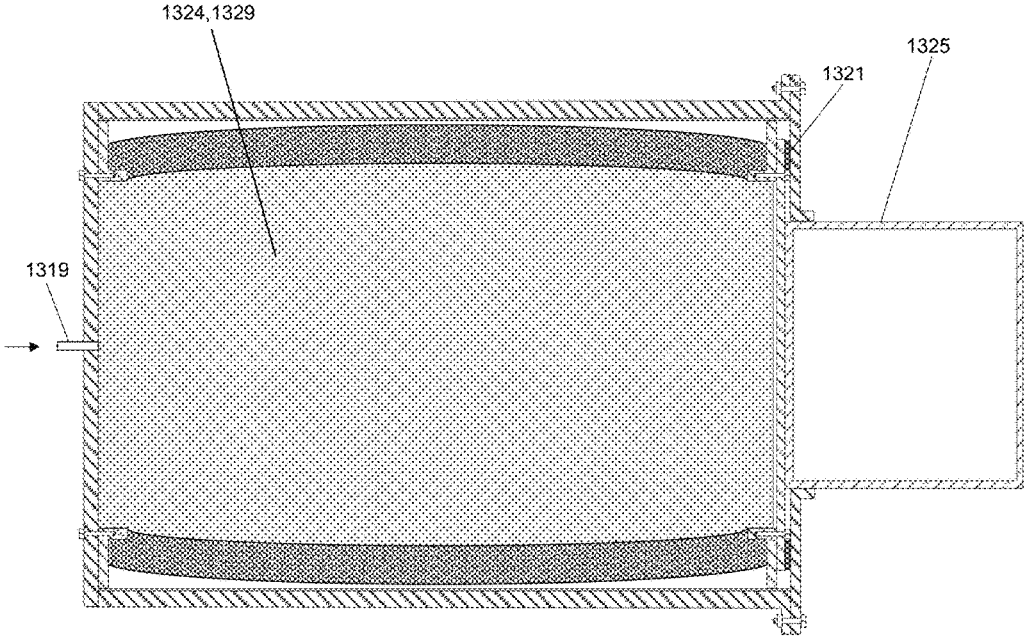
FIG. 14D illustrates a cross section view of the pistonless cylinder assembly configuration shown in FIG. 14A in a fully extended position in accordance with one embodiment.

Referring to FIG. 14D, a cross section view to show the pistonless cylinder, shown in FIG. 14A, in a fully extended position.

The key advantages of the preferred pistonless cylinder over a conventional cylinder are listed below:

1. The main body of a pistonless cylinder, including the pressured chamber and the barrel, is made of flexible material such as natural rubber and Aramid fibers, not rigid material such as steel as used for conventional cylinders. The barrel in a pistonless cylinder is not designed to take any pressure loading but only serves as a safety device and a decoration device to be made with non-metal materials such as plexiglass or fiberglass, or with a non-circular cross section shape for the barrel such as a square shape or a rectangular shape instead in order to suit different requirements. In addition, the annular gap between the barrel inner surface and the tubular outer surface can be filled with circulating water to control the temperature at the elastomer tubular outer surface. Consequently, the total weight of the preferred pistonless cylinder is significantly less than a conventional cylinder if both have the same size and the same loading capacity. In addition, the pistonless cylinder weight increase is insensitive to the cylinder internal pressure increase.

2. Use of reinforced fibers bonded with natural rubber as used for floating fenders, including Aramid fibers, to take high internal pressure is a mature off-the-shelf technology which has a long history of successful field applications under severe offshore environments with proven system durability and reliability and without a need for any maintenance under harsh offshore environments. In contrast, conventional cylinders require periodic maintenance with regular change of hydraulic oils and replacement of O-ring seals. In addition, the vast majority of conventional hydraulic cylinder failures are due to the failure of O-ring seals. In contrast, the pistonless cylinders have no O-ring seals in the system. Therefore, the overall system reliability and durability of pistonless cylinders should be much higher than conventional cylinders.

3. The preferred pistonless cylinder is environmentally more friendly because it uses ordinary water like seawater or fresh water instead of oil for hydraulic fluid. In addition, it does not need lubricant oil, if any, for the function of the system.

4. For underwater applications, a pistonless cylinder is independent of water depth in terms of cost, unlike conventional cylinders which need assistance of a water depth compensation device to maintain their effective power output.

5. The preferred pistonless cylinder enjoys considerable advantages over conventional load bearing systems, because it can be used directly as both hydraulic and pneumatic cylinders with very few, if any, adjustments because of the completely and reliably sealed chamber.

Figure 15A:
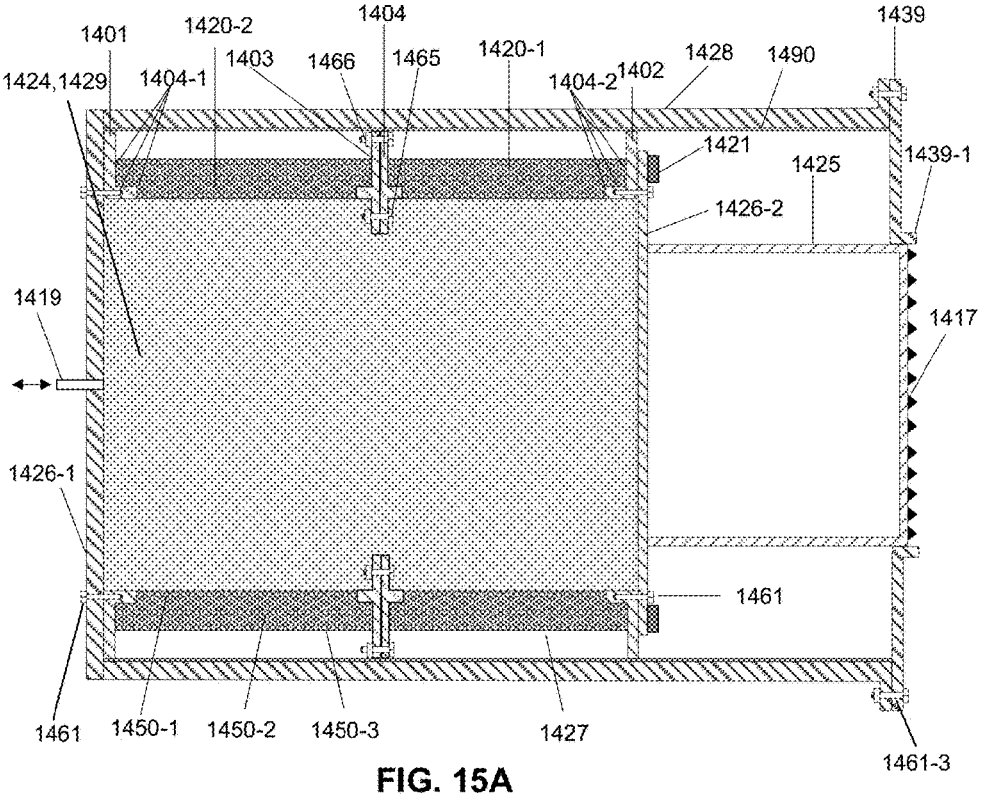
FIG. 15A illustrates a cross section view of a pistonless cylinder assembly configuration in a pre-activation position with two elastomer tubular units arranged in a serial configuration in accordance with one embodiment.
Figure 15B:
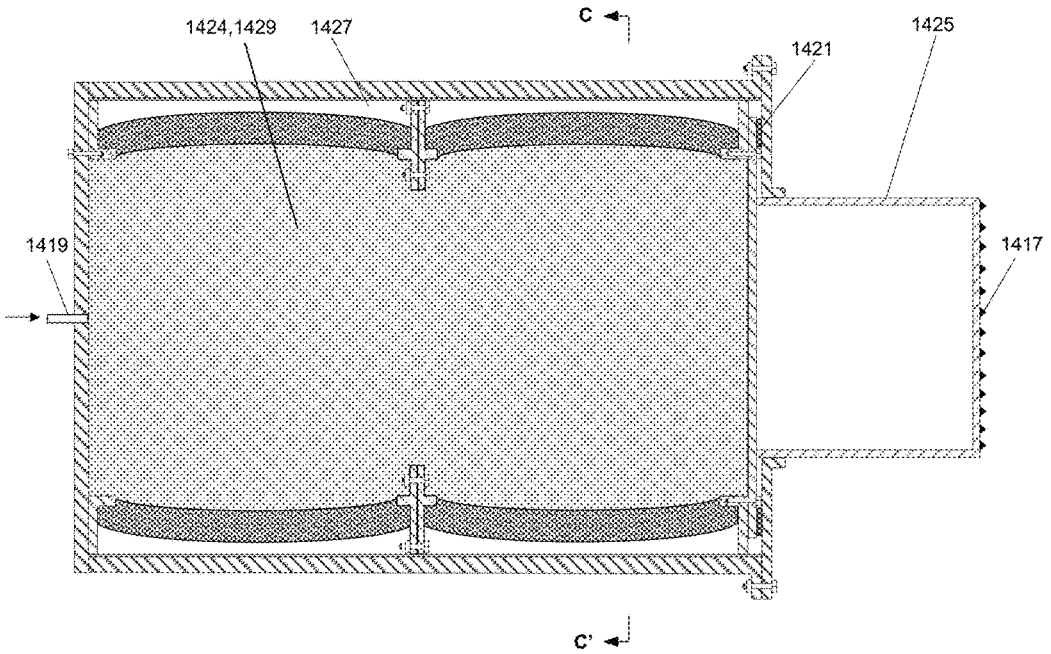
FIG. 15B illustrates a cross section view of the improved configuration of the pistonless cylinder assembly shown in FIG. 15A, in a fully extended position, in accordance with one embodiment.
Figure 15C:
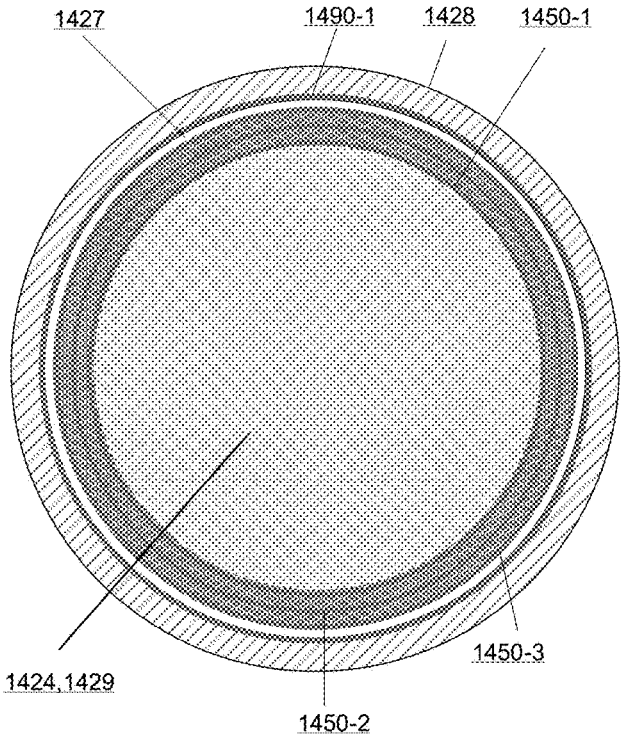
FIG. 15C illustrates the enlarged C-C' cut-off section view in FIG. 15B in accordance with one embodiment.

In accordance with one embodiment of the present disclosure, figures from FIG. 15A through FIG. 15C illustrate the key configurations of one modified pistonless cylinder assembly compared with the one shown in FIG. 14A. The modification made is to cut the elastomer tubular 1320, shown in FIG. 14A, into two equal length sections and to connect them in a serial configuration horizontally. The main purpose of doing so is to increase the elastomer tubular 1420 longitudinal stiffness in case that the elastomer tubular 1420 is so long with reduced longitudinal stiffness as to cause sagging.

Referring to FIG. 15A, a cross section view to show the pistonless cylinder in a pre-activation position. A pair of additional ring plates with an L-shape cross section 1403 and 1404 in combination added to the ring plates 1401 and 1402 and two elastomer tubulars 1420-1 and 1420-2 to form two extendable tubulars. Connecting the two extendable tubulars together with bolted connections 1465 and 1466 in a serial configuration forms a combined piece of extendable cylinder as shown. In addition, a set of cylinder head teeth is installed at the front head's front plate surface to function as a hydraulic cylinder as part of a pile gripper.

Referring to FIG. 15B, a cross section view to show the pistonless cylinder, shown in FIG. 15A, in a fully extended position. Referring to FIG. 15C, a C-C' cross section view shown in FIG. 15B.

Figure 16A:
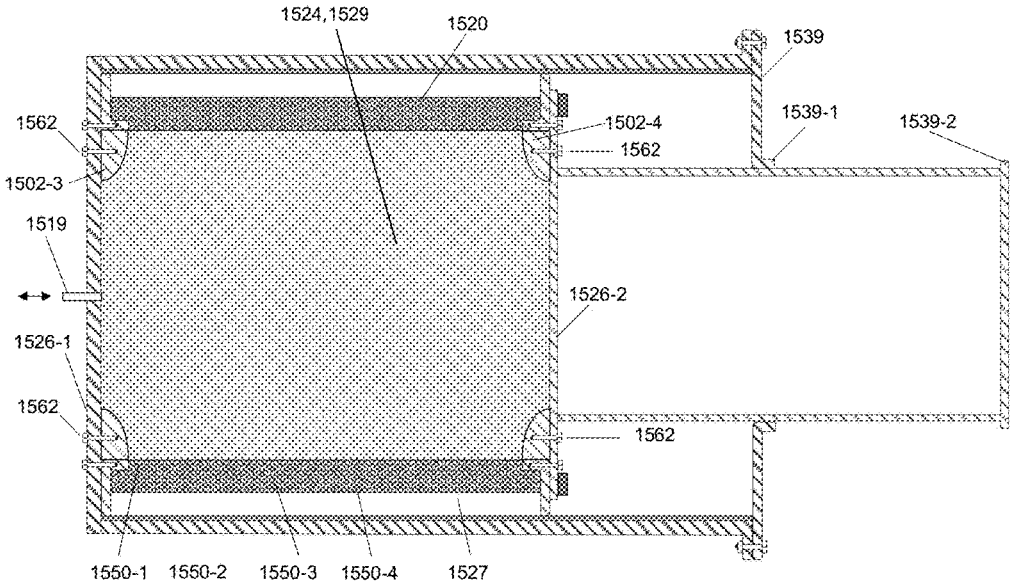
FIG. 16A illustrates a cross section view of a pistonless cylinder assembly configuration similar to the one shown in FIG. 14A except for such additions as two guide rings and the front head with an increased stroke distance plus a return stopper for a maximum return distance in accordance with one embodiment.
Figure 16B:
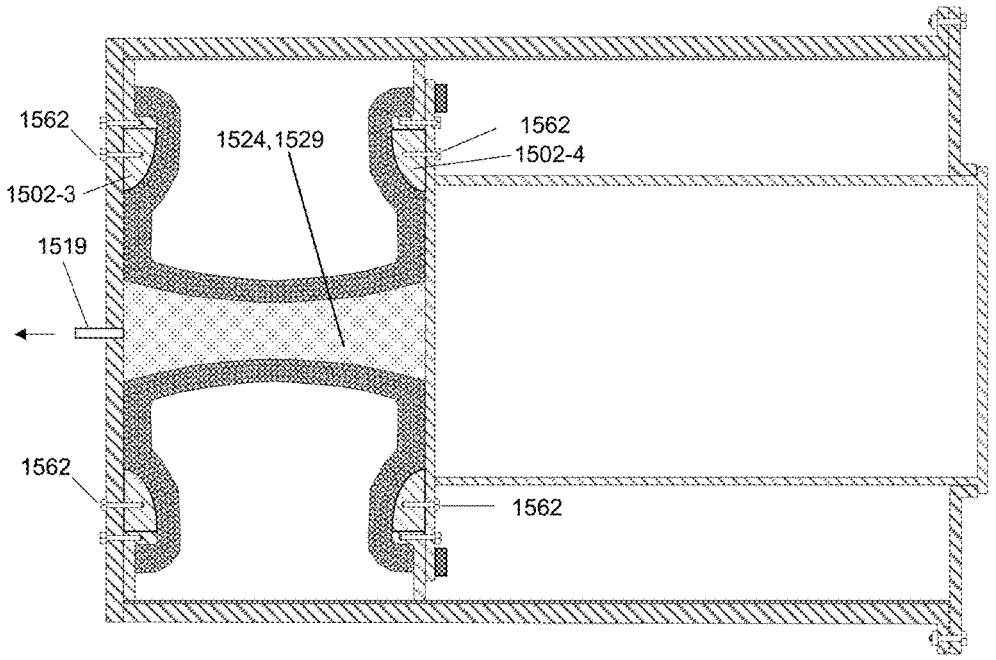
FIG. 16B illustrates a cross section view of the pistonless cylinder assembly configuration shown in FIG. 16A in a maximum retracted position utilizing a negative internal pressure induced suction force inside the pressure chamber in accordance with one embodiment.
Figure 16C:
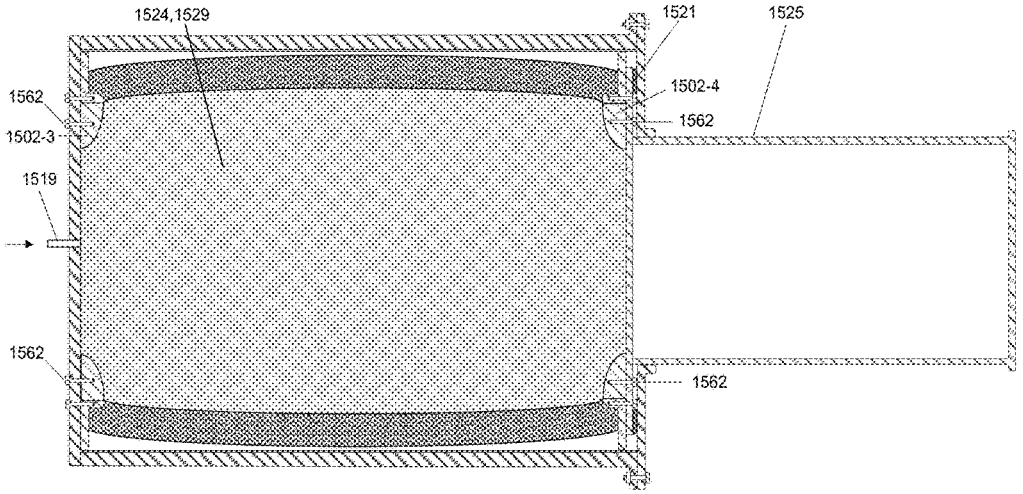
FIG. 16C illustrates a cross section view of the pistonless cylinder assembly configuration shown in FIG. 16A in a maximum extended position in accordance with one embodiment.

In accordance with one embodiment of the present disclosure, figures from FIG. 16A through FIG. 16C illustrate a cross section view of a pistonless cylinder assembly configuration similar to the one shown in FIG. 14A except for addition of two guide rings 1502-3 and 1502-4 and the front head 1525 with an increased stroke distance and a return stopper 1539-2, as an additional part of the traveling control system for the front head 1225 mentioned earlier, for a maximum retraction distance.

Referring to FIG. 16A, a cross section view to show a pistonless cylinder similar to the one shown in FIG. 14A, in a pre-activated position, except for addition of two guide rings 1502-1 and 1502-2 and the front head 1525 with an increased stroke distance and a return stopper 1539-2.

Referring to FIG. 16B, a cross section view to show the pistonless cylinder, shown in FIG. 15A, in a fully retracted position. A pump is able to take sufficient fluid 1524 volume out of the chamber 1529 through the supply pipe 1519 in order to create a negative pressure and a suction force inside the chamber 1529 forcing the wall of the elastomer tubular 1520 to sag inwardly toward the axis line of the chamber 1529 against both the end cap plate 1526-1 inner surface and the front cap plate 1526-2 inner surface as shown. Consequently, a maximum retraction distance is achieved.

Referring to FIG. 16C, the pistonless cylinder shown in 16A reaches the maximum stroke distance when fluid 1524 is injected into chamber 1529 through the pipe 1519.

In one embodiment, the elastomer tubular may be substituted with tubular made with other flexible material.

Although some preferred configurations of a pistonless cylinder load bearing system in accordance with the present invention have been described herein with respect to a limited number of embodiments, those skilled in the art will recognize that various substitutions and modifications may be made to the specific features described above without departing from the scope and spirit of the invention as recited in the appended claims.

Finally, it should be pointed out that any steel surfaces inside the chamber of the assembly exposed to water in all the embodiments listed above should be properly treated with anticorrosion painting or coating, because pistonless cylinders use water instead of oil as their hydraulic fluids.

What is claimed is:

1. A load bearing and power transmission device, which employs no piston, no piston rod, no sealing rings and no oil based hydraulic fluid, comprising:

at least one extendable unit, comprising:

(a) a flexible tubular;

(b) a plurality of reinforced fiber layers wrapped between two annular thin rubber layers of the flexible tubular with vulcanized bonding between the reinforced fibers layers and the rubber layers, wherein each reinforced fiber layer is made of one continuous single string, or several reinforced fiber layers woven together into a single continuous strip, in a coil-like wrapping pattern, wraps around an annular thin rubber layer surface of the flexible tubular from one end to the other end with a horizontal offset relative to the adjacent layers of reinforced fiber above or below; and (c) a pair of ring plates, each ring plate connected to each end of the extendable unit;

an end cap plate to have a sealed connection to the back of the extendable unit and a front cap plate attached with a front head to have a sealed connection to the front of the extendable unit to form a completely sealed and extendable chamber for transmission medium, wherein the completely sealed and extendable chamber has no sliding surface inside the chamber;

a traveling control device for providing a unidirectional guidance and traveling distance control of the front head;

a barrel for housing the completely sealed and extendable chamber and for providing a supporting base to the traveling control device;

an annular gap between the barrel inner surface and the elastomer tubular outer surface; and a supply line, one end connected to the inside of the sealed and extendable chamber and the other end connected to a nearby device, for taking transmission medium into and out of the completely sealed and extendable chamber.

2. The load bearing and power transmission device according to claim 1 wherein each of the ring plates, having a L-shape cross section, has a bonded connection between the ring plate surfaces and the surface of one end of the extendable unit.

3. The load bearing and power transmission device according to claim 1, wherein each of the flexible tubular is an elastomer tubular.

4. The load bearing and power transmission device according to claim 1, wherein the coil-like wrapping pattern is a parallel pattern.

5. The load bearing and power transmission device according to claim 1, wherein the coil-like wrapping pattern is a crisscrossing coil-like wrapping pattern with a maximum crisscross angle less than 8 degrees.

6. The load bearing and power transmission device according to claim 1, wherein the reinforced fiber is Aramid fiber.

7. The load bearing and power transmission device according to claim 1, wherein the reinforced fiber is a steel wire.

8. The load bearing and power transmission device according to claim 1, wherein a plurality of extendable units are horizontally connected in a serial configuration between each pair of extendable units.

9. The load bearing and power transmission device according to claim 8, wherein the horizontal connection is made by bolting between each pair of extendable units.

10. The load bearing and power transmission device according to claim 1 further comprising:

(a) a plurality of curved plastic plates, each plastic plate with a circular recess used for housing a bolted connection with a buried nut inside a pipe which is bonded to the flexible tubular, wherein each plastic plate is able to slide at a surface of another plate both longitudinally and annularly;

(b) a plastic tubular with its outer surface against the barrel inner surface; and (c) a second annular gap between the plastic tubular inner surface and the curved plastic plater outer surfaces, wherein the second annular gap width is sufficient for avoiding any contact under a pre-activation condition.

11. The load bearing and power transmission device according to claim 10, wherein the plastic plates and the plastic tubular are made of UHMWPE material.

12. The load bearing and power transmission device according to claim 1 further comprising:

(a) a plastic tubular inserted inside the barrel with the plastic tubular outer surface against the barrel inner surface; and (b) a third annular gap between the plastic tubular inner surface and the flexible tubular outer surface, wherein the third annular gap width is sufficient for avoiding any contact under normal operation conditions.

13. The load bearing and power transmission device according to claim 12, wherein the plastic tubular is made of UHMWPE material.

14. The load bearing and power transmission device according to claim 13, wherein the third annular gap is filled with circulating water during normal operations.

15. The load bearing and power transmission device according to claim 1, where the barrel is made of non-metal materials.

16. The load bearing and power transmission device according to claim 1, where the barrel has a non-circular cross section shape.

17. The load bearing and power transmission device according to claim 1, wherein the traveling control device comprising:

(a) a third ring plate, with its outer annular surface connected to the barrel front, having a L-shape cross section shorter arm as a guide for the front head forward extension and return retraction;

(b) a rubber ring plate installed at the third ring plate inner surface to serve as a stopper for the forward extension; and (c) a fourth ring plate installed at the front head surface as a return stopper for the front head backward retraction.

18. The load bearing and power transmission device according to claim 1, wherein the load bearing and power transmission device is a hydraulic cylinder, the transmission medium into and out of the completely sealed and extendable chamber is water and the nearby device is a pump.

19. The load bearing and power transmission device according to claim 1, wherein the load bearing and power transmission device is a pneumatic cylinder, the transmission medium into and out of the completely sealed and extendable chamber is air and the nearby device is an air compressor.

20. The load bearing and power transmission device according to claim 1, wherein the nearby device is able to take sufficient transmission medium out of the chamber to create a suction force inside the chamber forcing the wall of the extendable unit to sag inwardly toward the axis line of the chamber.

21. The load bearing and power transmission device according to claim 1, wherein the sealed connections between the end cap plate and the extendable unit and between the front cap plate and the extendable unit are bolted connections.

* * * * *